US006219972B1

(12) United States Patent
Zusy

(10) Patent No.: US 6,219,972 B1
(45) Date of Patent: Apr. 24, 2001

(54) METHOD AND APPARATUS FOR PREVENTING BLOCKAGE OF A WATER FLOW PATH

(76) Inventor: Matthew S. Zusy, 4423 Edgerton Rd., North Royalton, OH (US) 44133

( * ) Notice: Subject to any disclaimer, the term of this patent is extended or adjusted under 35 U.S.C. 154(b) by 0 days.

(21) Appl. No.: 09/392,149

(22) Filed: Sep. 8, 1999

(51) Int. Cl.[7] ..... E04D 13/08
(52) U.S. Cl. ..... 52/12; 52/11; 137/121
(58) Field of Search ..... 52/11, 12, 16; 210/153, 156, 407, 411, 474, 477; 137/120, 121

(56) References Cited

U.S. PATENT DOCUMENTS

| | | | | |
|---|---|---|---|---|
| 527,400 | | 10/1894 | Barth . | |
| 752,547 | | 2/1904 | Harris et al. . | |
| 1,021,410 | * | 3/1912 | Johnson | 137/121 |
| 1,136,538 | | 4/1915 | Kuenzli . | |
| 1,254,125 | | 1/1918 | Dash . | |
| 1,383,547 | | 7/1921 | Konsalik . | |
| 1,532,013 | | 3/1925 | Winans . | |
| 1,653,473 | | 12/1927 | Schulz . | |
| 5,526,612 | * | 6/1996 | Wade | 52/12 |
| 5,709,051 | * | 1/1998 | Mazziotti | 52/12 |
| 5,985,158 | * | 11/1999 | Tiderington | 52/12 X |

FOREIGN PATENT DOCUMENTS

| | | | | |
|---|---|---|---|---|
| 673867 | * | 4/1990 | (CH) | 52/16 |
| 634710 | * | 2/1928 | (FR) | 137/121 |
| 2132657 | * | 7/1984 | (GB) | 52/12 |

* cited by examiner

*Primary Examiner*—James O. Hansen
(74) *Attorney, Agent, or Firm*—Tarolli, Sundheim, Covell, Tummino & Szabo L.L.P.

(57) ABSTRACT

A method and apparatus for preventing blockage of a water flow path from a gutter of a building through a downspout includes a receptacle which is rotatably supported beneath the gutter. The receptacle is movable between a collecting orientation and an emptying orientation under the influence of the weight of water and debris conducted from the gutter to the receptacle when the receptacle is in the collecting orientation. The receptacle includes a compartment having an outlet through which water passes prior to collection of debris in the compartment. As debris collects in the compartment and at least partially blocks the outlet so that water also collects in the compartment, the combined center of gravity of the receptacle and the water and debris in the compartment moves from one side of a vertical plane containing the axis about which the receptacle rotates to the opposite side of the plane. As this occurs, the receptacle is rotated from the collecting orientation to the emptying orientation. It is contemplated that the receptacle may be constructed with either a single compartment or a plurality of compartments.

34 Claims, 9 Drawing Sheets

METHOD AND APPARATUS FOR PREVENTING BLOCKAGE OF A WATER FLOW PATH

BACKGROUND OF THE INVENTION

The present invention relates to a method and apparatus for preventing blockage in a water flow path from a gutter of a building through a downspout.

A gutter is commonly utilized to collect rainwater from a roof of a building. Debris, such as leaves and other materials may be conducted from the roof to the gutter along with the rainwater. The gutter is usually connected with a downspout through which water is conducted away from the gutter. The downspout may conduct the rainwater to a location spaced from the building.

Unfortunately, after a period of time, debris, such as leaves and other materials, collect in the gutter and tend to block the downspout. When this occurs, water can no longer be conducted from the gutter through the downspout. The gutter may then over flow in a manner which may create building maintenance problems.

In order to eliminate the problems which result from downspouts becoming blocked by debris, it has previously been suggested that filters or strainers be associated with the downspout. These filters or strainers may be made of wire mesh or screen on which debris is collected. It has previously been suggested that the screen or mesh could slope downwardly so that the debris can be discharged from the screen. Devices having this known construction are illustrated in U.S. Pat. Nos. 752,547 and 1,653,473.

SUMMARY OF THE INVENTION

The present invention relates to a new and improved method and apparatus for use in preventing blockage of a water flow path from a gutter of a building through a downspout. The apparatus may include a receptacle which is disposed beneath the gutter and is connected in fluid communication with the downspout. A flow of water and debris from the gutter is conducted into the receptacle.

A flow of water is connected through an outlet from the receptacle while the debris collects in the receptacle. As the debris collects in the receptacle, it blocks the outlet from the receptacle. As water and debris accumulate in the receptacle, their combined weight effects movement of the receptacle from the collecting orientation to an emptying orientation to dump the water and debris from the receptacle.

In one specific embodiment of the receptacle, the outlet from the receptacle is formed by a wall portion of the receptacle through which the water passes prior to collection of debris in the receptacle. As the debris accumulates in the receptacle, the center of gravity of the combined mass of the receptacle and the water and debris in the receptacle may move from a location disposed on one side of an axis about which the receptacle is rotatable to an opposite side of the axis. As this occurs, the weight of the water and debris collected in the receptacle causes the receptacle to rotate from the collecting orientation to the emptying orientation.

The receptacle may have a plurality of compartments. In one embodiment of the invention, a main compartment of the receptacle is filled with water and debris. A secondary compartment of the receptacle receives water from the main compartment. As the secondary compartment is filled with water, the center of gravity of the receptacle and the water and debris moves relative to an axis about which the receptacle is rotatable to cause rotation of the receptacle to dump the water and debris from the receptacle.

In another embodiment of the invention, a plurality of receptacles sequentially receive water and debris. When a first one of the receptacles becomes at least partially filled with water and debris, the receptacle is moved from a collecting orientation to an emptying orientation. As the first receptacle moves from the collecting orientation to the emptying orientation, a second receptacle moves to the collecting orientation and receives water and debris. The receptacles may be disposed in any one of several spatial relationships relative to each other including a circular array. If desired, a plurality of receptacles may be arranged in series along a path flow of water from a gutter.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Rainwater is conducted from a roof of a building (not shown) to a gutter 30 (FIG. 1) which is connected with the building in a known manner. The gutter 30 forms a trough in which rainwater is collected. The flow of rainwater into the gutter 30 frequently includes debris, such as leaves, sticks, and other articles deposited on a roof or other portion of a building. Although the gutter 30 is advantageously utilized to collect rainwater from the roof of the building, it is contemplated that the gutter could be utilized to collect water from other locations in a building or to collect water in other environments.

A downspout 32 is connected in fluid communication with the gutter 30. The downspout 32 forms a conduit through which rainwater is conducted. The downspout 32 may conduct the rainwater to a location spaced from the building, such as to a sewer. Alternatively, the downspout 32 may conduct the rainwater to a cistern where the rainwater is collected.

Figure 1:
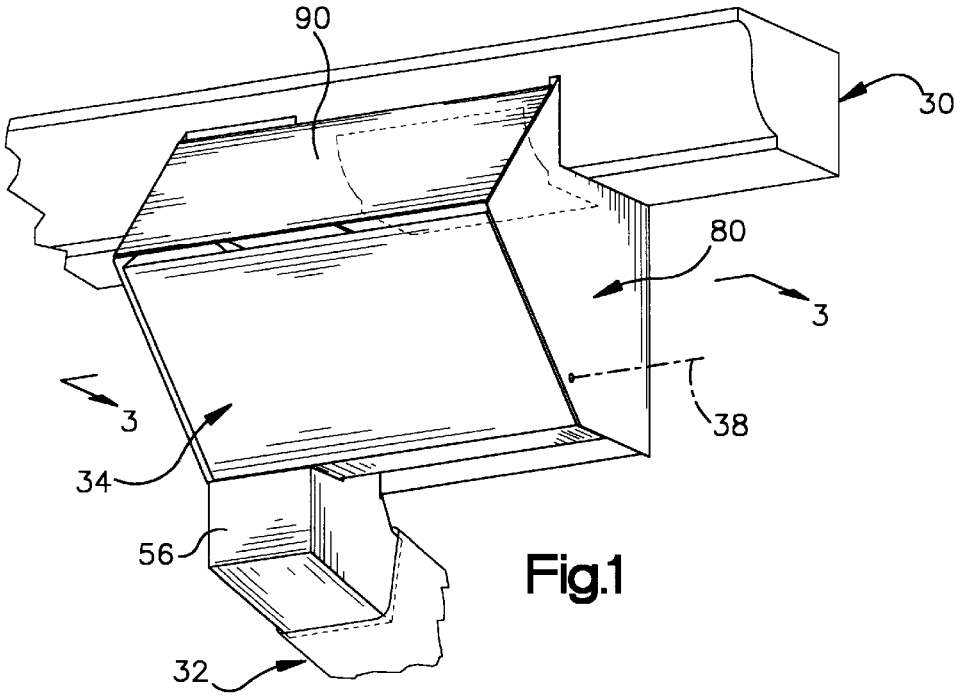
FIG. 1 is a simplified fragmentary pictorial illustration of an apparatus which is constructed and operated in accordance with the present invention to prevent blockage of a water flow path from a gutter of a building through a downspout.
Figure 2:
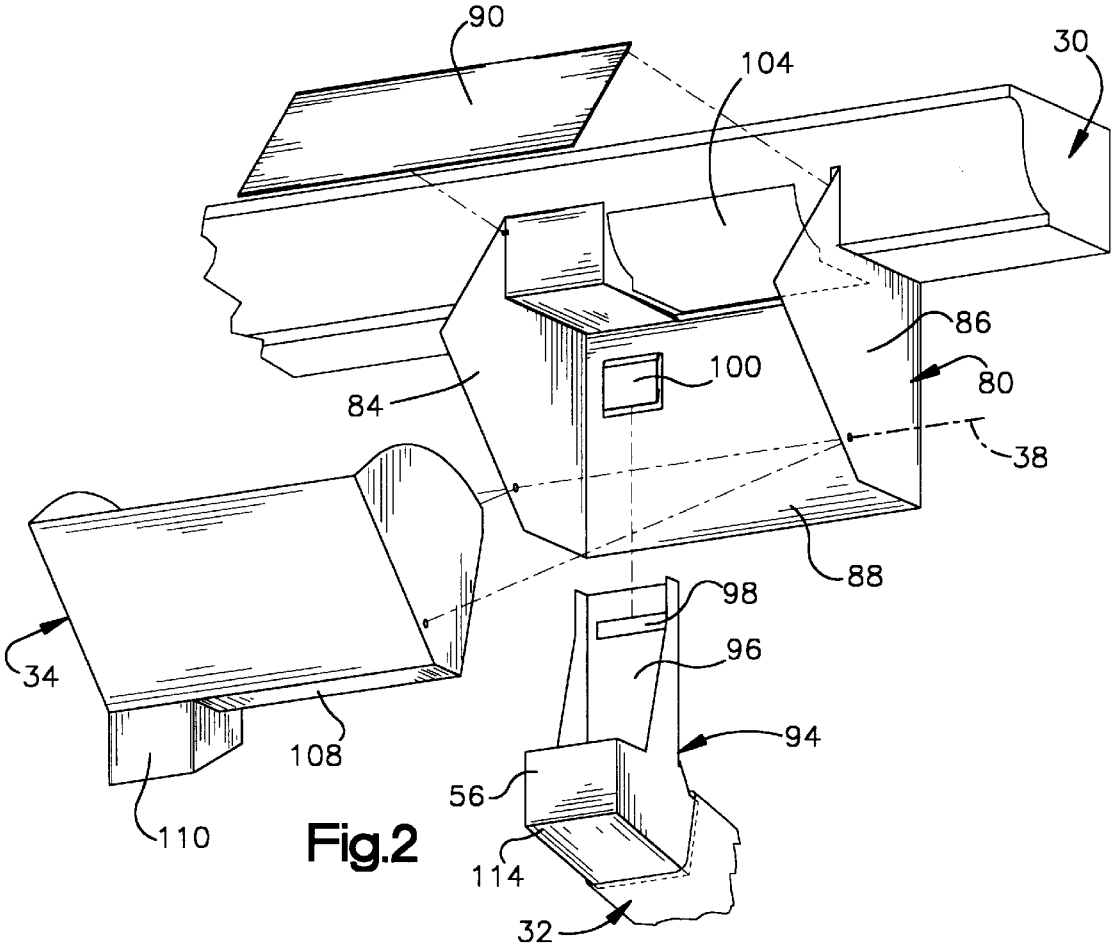
FIG. 2 is a simplified, partially exploded, fragmentary illustration of the apparatus of FIG. 1.
Figure 4:
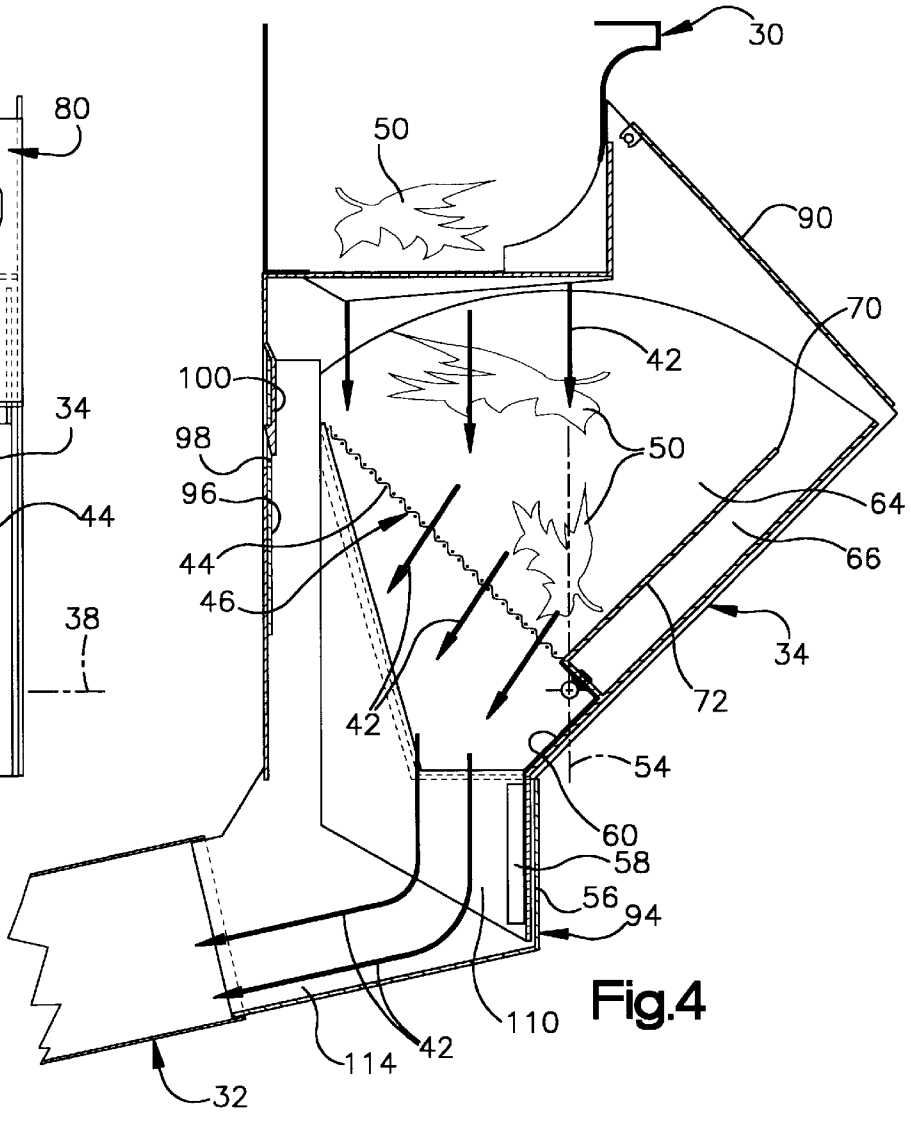
FIG. 4 is a sectional view, taken generally along the line 4—4 of FIG. 3, further illustrating the relationship of the apparatus to the gutter, the path of water flow through the receptacle, and the manner in which debris is accumulated in the receptacle.
Figure 3:
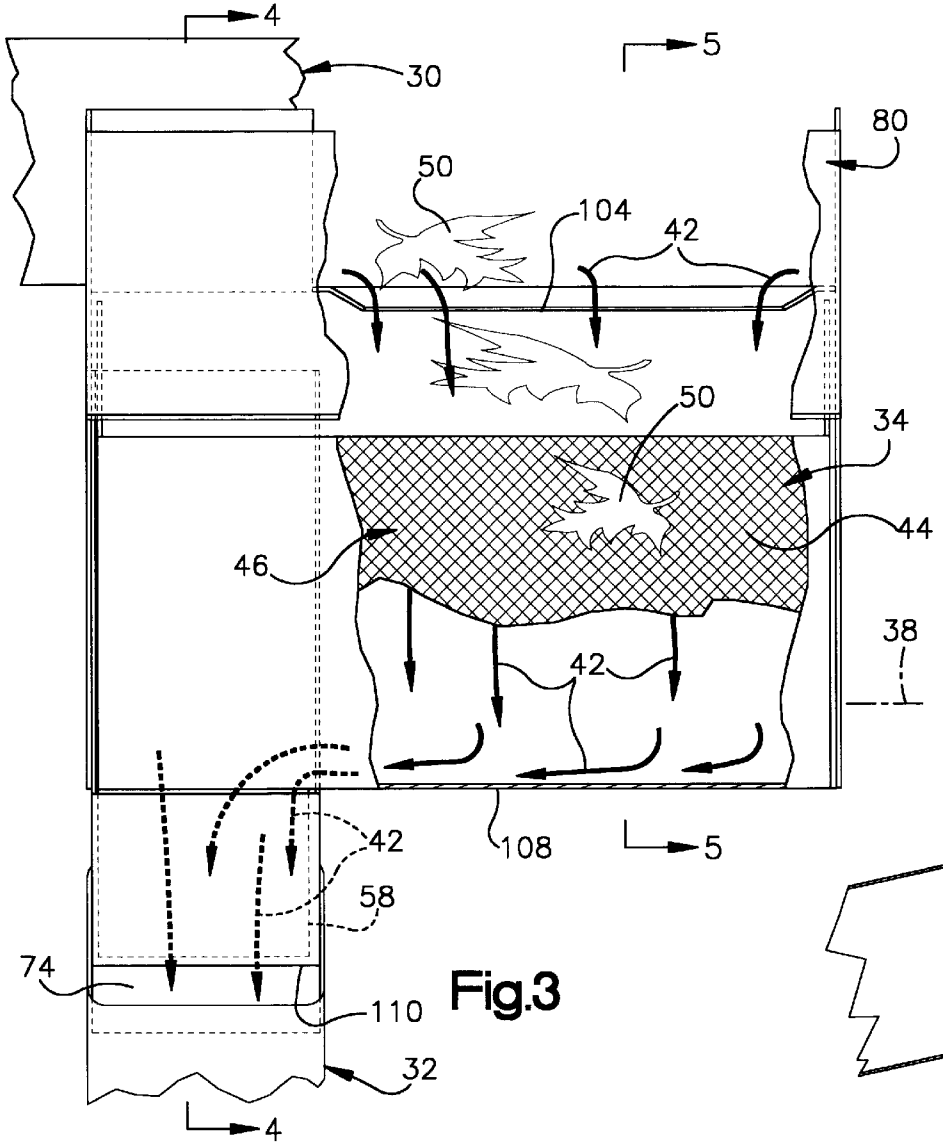
FIG. 3 is an enlarged fragmentary sectional view, taken generally along the line 3—3 of FIG. 1, schematically illustrating the path of flow of water from the gutter and the manner in which debris is collected at an outlet from a receptacle in the apparatus of FIG. 1.
Figure 10:
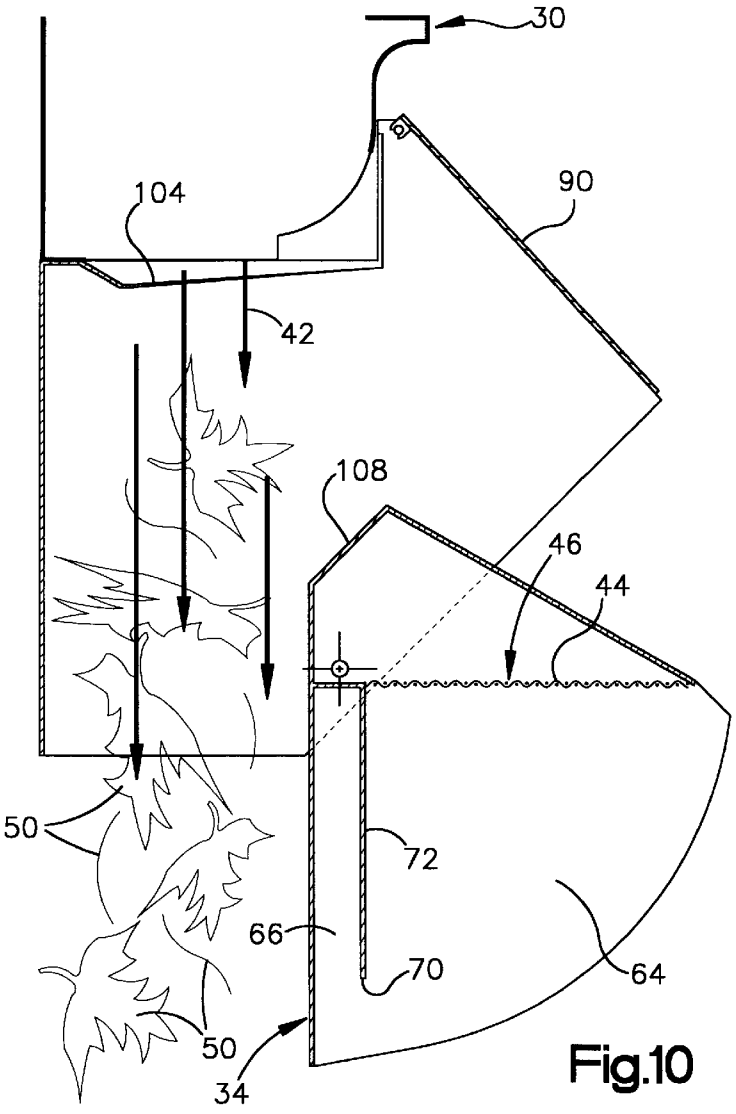
FIG. 10 is a fragmentary sectional view, generally similar to FIG. 5, illustrating the manner in which water and debris may flow past the receptacle when it is in the emptying orientation of FIG. 9.

In accordance with a feature of the present invention, a receptacle 34 (FIGS. 1–10) is disposed beneath the gutter 30. The receptacle 34 is pivotal about a horizontal axis 38 (FIGS. 1–3). The receptacle 34 is rotatable about the axis 38 from a collecting orientation (FIGS. 3–6), through an intermediate orientation (FIGS. 7 and 8), to an emptying orientation (FIGS. 9 and 10). When the receptacle 34 is in the collecting orientation of FIGS. 3–6, water, indicated schematically by arrows 42 in FIGS. 3 and 4, is conducted from the gutter 30 to the receptacle 34. The water 42 passes through an outlet 44 from the receptacle 34.

In accordance with one of the features of the present invention, the outlet 44 is formed by a foraminous wall portion 46 of the receptacle 34. The wall portion 46 is formed by a mesh or screen through which the water 42 can pass. If desired, the wall portion 46 could be formed by a piece of sheet metal in which a plurality of small openings have been punched or otherwise formed.

In an illustrated body of the invention, the outlet 44 is formed by the wall portion 46 of the receptacle 34. Although it is believed that this construction will be preferred, it is contemplated that the outlet could be formed in a different manner. For example, outlet openings could be formed at locations other than in the wall portion 46 if desired.

Along with the rainwater 42, debris 50 is conducted from the gutter 30 to the receptacle 34 in a manner indicated schematically in FIGS. 3 and 4. The debris 50 may be leaves, sticks, seeds or nuts from trees, or other materials which accumulate on a roof or other portion of a building. The debris 50 is conducted along with the rainwater into the receptacle 34. The water, indicated schematically by the arrows 42 in FIG. 4, flows through the outlet 44 formed by the wall portion 46 of the receptacle 34. However, the debris 50 is separated from the flow of water 42 by the foraminous wall portion 46 of the receptacle 34. Therefore, the debris 50 accumulates on the wall portion 46 of the receptacle 34 in the manner indicated schematically in FIG. 6.

As the water 42 and debris 50 continue to flow from the gutter 30 into the receptacle 34, the amount of debris accumulated on the wall portion 46 increases. As the quantity of debris deposited on the wall portion 46 increases, the debris is effective to retard the flow of water through the wall portion. Eventually, the debris 50 will almost completely block the wall portion 46, in a manner indicated schematically in FIG. 6, so that the water 42 accumulates in the receptacle 34.

Prior to the accumulation of water 42 and debris 50 in the receptacle 34, the receptacle 34 has a center of gravity which is disposed to the left (as viewed in FIG. 4) of a vertical plane 54 which contains the horizontal axis 38. However, as the water 42 and debris 50 accumulate in the receptacle 34, the combined mass of the receptacle 34 and the water 42 and debris 50 has a center of gravity which moves from the left (as viewed in FIG. 4) of the vertical plane 54 to the right of the vertical plane.

Figure 8:
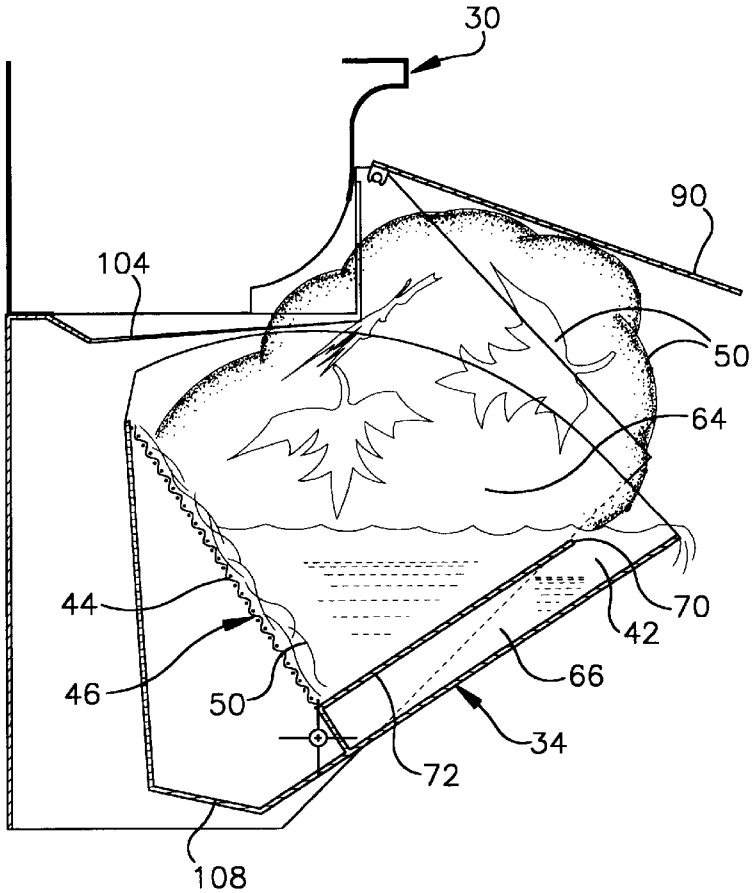
FIG. 8 is a schematic illustration, generally similar to FIG. 5, illustrating a manner in which an accumulation of an excessive amount of debris in the receptacle may cause a flap to pivot from the closed condition of FIGS. 4 and 7 to an open condition as water and debris are collected in the receptacle and/or during movement of the receptacle from the collecting orientation of FIG. 4 toward an emptying orientation.
Figure 7:
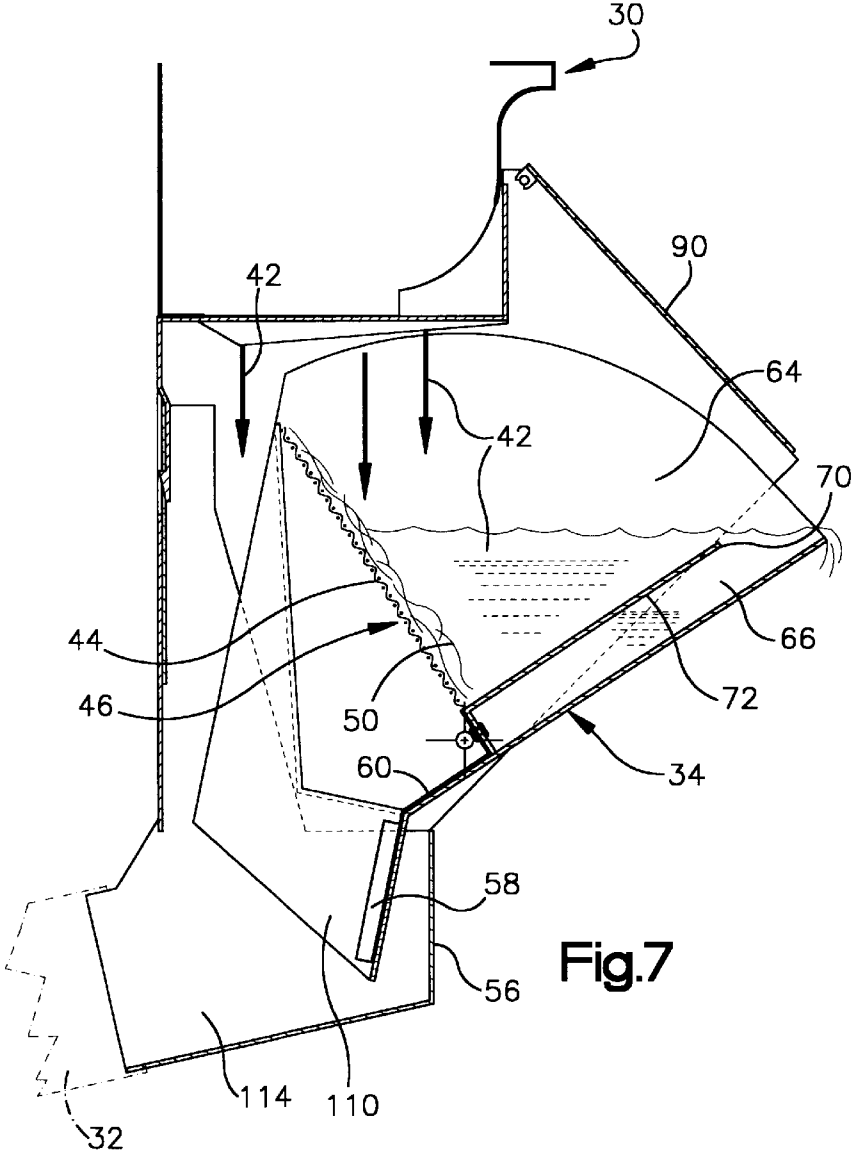
FIG. 7 is a fragmentary sectional view, generally similar to FIG. 6, illustrating the manner in which the receptacle is rotated from the collecting orientation of FIG. 6 toward an emptying orientation under the influence of the weight water and debris accumulated in the receptacle.
Figure 9:
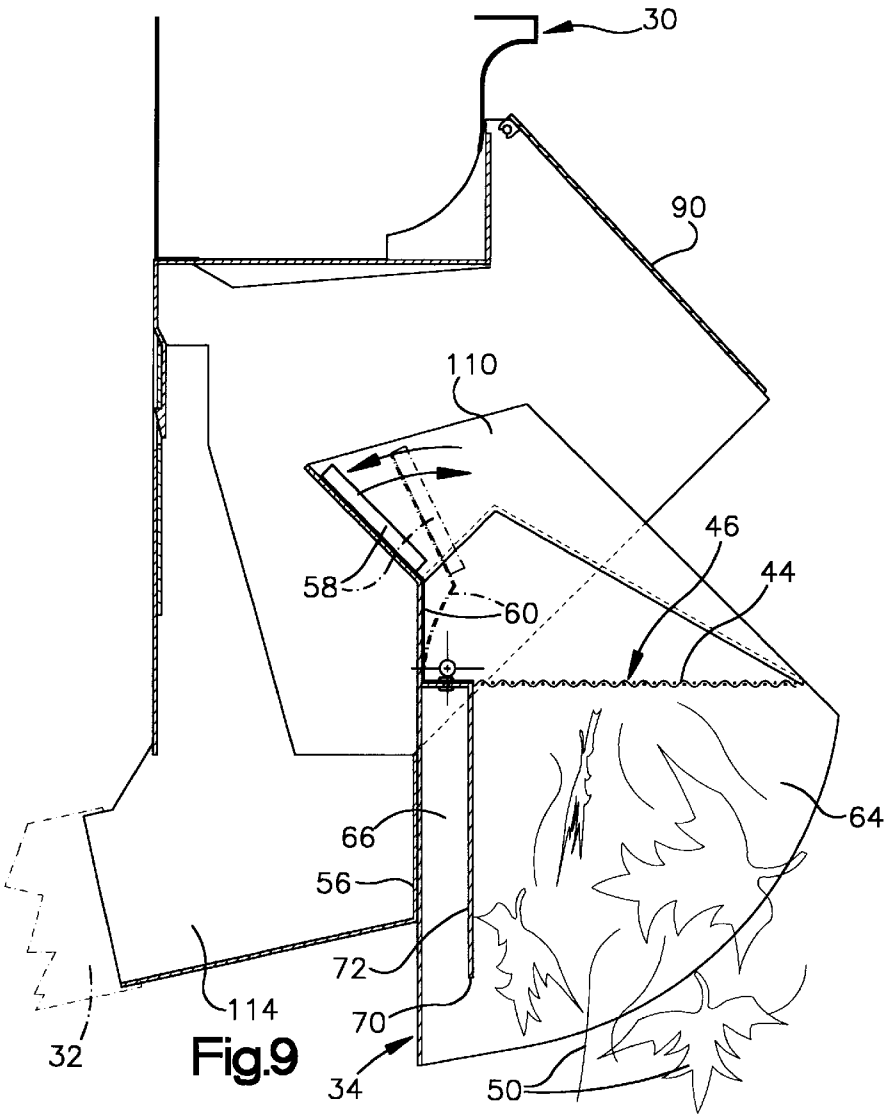
FIG. 9 is a fragmentary sectional view, generally similar to FIG. 4, illustrating the receptacle in the emptying orientation.
Figure 12:
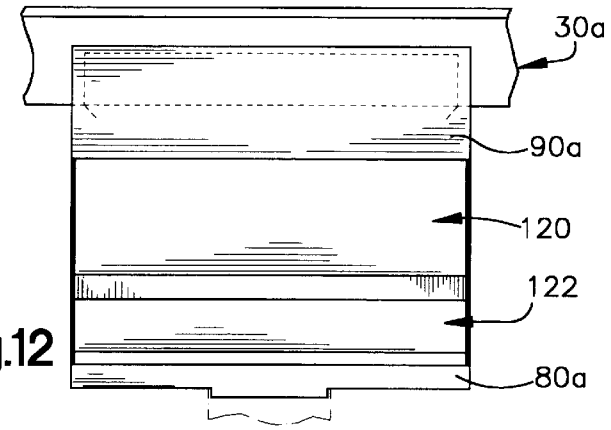
FIG. 12 is a simplified elevational view, taken generally along the line 12—12, of FIG. 11, further illustrating the relationship of the apparatus to the gutter.

When the center of gravity of the receptacle 34 and the mass of water 42 and debris 50 in the receptacle shifts to the right of the vertical plane 54, the receptacle 34 begins to rotate about the horizontal axis 38, in the manner indicated schematically in FIGS. 7 and 8. As the receptacle 34 rotates from the upwardly opening collecting orientation of FIG. 4 through the intermediate orientations of FIGS. 7 and 8 to the downwardly opening emptying orientation of FIGS. 9 and 10, the water 42 and debris 50 are dumped from the receptacle 34. When the receptacle 34 reaches the emptying orientation of FIG. 9, the receptacle engages a stop panel 56.

As the receptacle 34 moves from the collecting orientation to the emptying orientation, the receptacle 34 moves out of the path of flow of water 42 and debris 50 from the gutter 30 (FIG. 10). Therefore, during a relatively short period of time in which the receptacle 34 is in the emptying orientation of FIGS. 9 and 10, water 42 and debris 50 from the gutter 30 are dropped to the ground in an area adjacent to the building. This prevents the downspout 32 from becoming jammed with debris while the receptacle 34 is in the emptying orientation.

In the illustrated embodiment of the invention, the receptacle 34 includes a counterweight 58. The counterweight 58 forms part of a mass of the receptacle 34 and urges the receptacle to the upwardly opening collecting orientation shown in FIG. 4. However, as the receptacle rotates from the collecting orientation of FIG. 4 through the intermediate orientations of FIG. 7 and 8 to the emptying orientation of FIG. 9, the counterweight 58 accelerates in a clockwise direction (as viewed in FIGS. 4 and 9).

When the rotation of the receptacle 34 is interrupted at the emptying orientation of FIG. 9, a resilient portion 60 of the receptacle flexes under the influence of the inertia of the counterweight 58. This results in the counterweight 58 being effective to initiate movement of the receptacle 34 from the emptying orientation of FIGS. 9 and 10 back toward the collecting orientation of FIG. 4 with a snap action. Therefore, the amount of time during which the receptacle 34 is in the emptying orientation is minimized. This results in the amount of time during which water 42 and debris 50 bypass the receptacle 34, in the manner indicated schematically in FIG. 10, being minimized.

Although the counterweight 58 is utilized to urge the receptacle 34 toward the collecting orientation of FIGS. 3 and 4, it is contemplated that the receptacle 34 could be biased toward the collecting orientation in a different manner if desired. For example, a spring could be utilized to urge the receptacle 34 toward the upright collecting orientation of FIGS. 3 and 4 if desired.

In accordance with another feature of the invention, the receptacle 34 includes a plurality of compartments. Thus, the receptacle 34 includes a main compartment 64 and a secondary compartment 66 (FIGS. 4–10). When the receptacle 34 is in the upright orientation of FIG. 4, the water 42 and debris 50 flow into the main compartment 64. As the debris 50 accumulates, the outlet 44 formed by the wall portion 46 of the receptacle 34 is blocked and the amount of water in the main compartment 64 increases.

Figure 6:
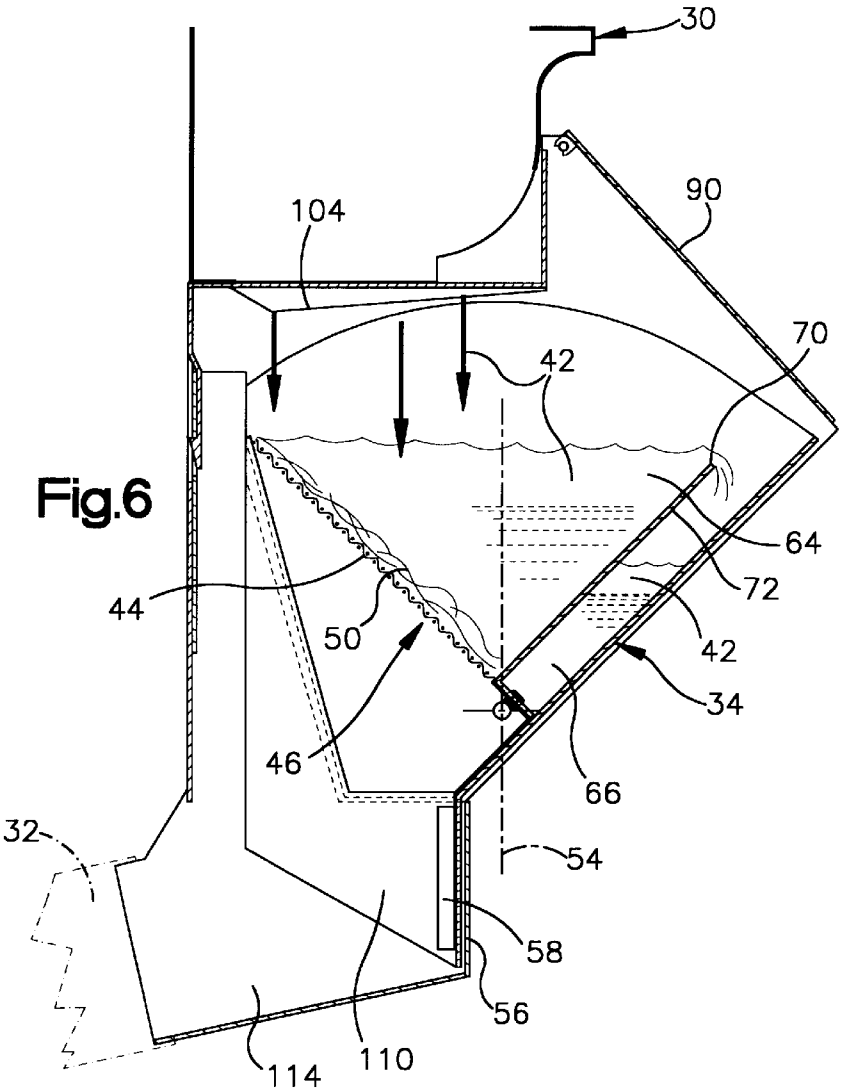
FIG. 6 is a fragmentary sectional view, generally similar to FIG. 4, illustrating the manner in which debris at least partially blocks an outlet from the receptacle so that water flows from a main compartment of the receptacle to a secondary compartment.

When the outlet 44 is almost completely blocked by the debris 50, the water begins to flow over an upper edge or lip 70 of an inner wall 72 which separates the main compartment 64 from the secondary compartment 66, in the manner illustrated schematically in FIG. 6. Prior to initiation of the flow of water 42 from the main compartment 64 into the secondary compartment 66, the combined center of gravity of the receptacle 34, including the counterweight 58, the water 42 in the main compartment, and the debris 50 in the main compartment is disposed to the left (as viewed in FIGS. 4 and 6) of the vertical plane 54 containing the horizontal axis 38 (FIG. 3) about which the receptacle 34 is rotatable. As water 42 begins to accumulate in the secondary compartment 66, in a manner illustrated in FIG. 6, the combined center of gravity of the receptacle 34, water 42 and debris 50 moves toward the right (as viewed in FIG. 6).

When the secondary compartment 66 is almost completely filled with water 42, the combined center of gravity of the receptacle 34, water 42 and debris 50 will have moved to the right (as viewed in FIG. 6) of the vertical plane 54. At this time the weight of the receptacle 34, water 42 and debris 50 applies a torque to the receptacle urging the receptacle to pivot in a clockwise direction, as viewed in FIG. 6, about the horizontal axis 38 (FIG. 3).

As the receptacle 34 begins to pivot about the horizontal axis 38, in a manner indicated schematically in FIGS. 7 and 8, the combined center of gravity in the receptacle 34, water 42 and debris 50 shifts further to the right (as viewed in FIGS. 7 and 8). This increases the torque inducing clockwise rotational movement of the receptacle 34 about the axis 38. This results in the acceleration of the receptacle 34 toward the emptying orientation of FIGS. 9 and 10.

When the receptacle 34 stops at the emptying orientation of FIGS. 9 and 10, the counterweight 58 is effective to quickly induce reverse or counter clockwise (as viewed in FIGS. 9 and 10) rotation of the receptacle 34. This results in the receptacle quickly moving back to the upright orientation of FIGS. 3 and 4.

Although it is preferred to provide the secondary compartment 66 in the receptacle 34, the inner wall 72 could be eliminated so that the receptacle has a single compartment. The single compartment would have a size corresponding to the combined size of the main compartment 64 and the secondary compartment 66. However, it is believed that it will be preferred to form the receptacle 34 with the secondary compartment 66 to increase the stability of the receptacle 34 in the upright orientation of FIGS. 4 and 5 until a sufficient volume of water has accumulated in the main compartment 64 to enable the water to flow from the main compartment to the secondary compartment 66.

The First Embodiment

In the embodiment of the invention, FIGS. 1–10, the receptacle 34 is pivotally mounted beneath the gutter 30 (FIG. 1). To support the receptacle 34 beneath the gutter, a frame or support member 80 (FIGS. 1 and 2) is fixedly connected with the gutter 30. The support member 80 has a pair of parallel sidewalls 84 and 86 (FIG. 2) which are fixedly connected with a gutter 30. An end wall 88 extends between the sidewalls 84 and 86. The receptacle 34 is pivotally mounted on the sidewalls 84 and 86 for rotation about the horizontal axis 38.

A flap or door 90 (FIGS. 1 and 2) is pivotally mounted on the side walls 84 and 86 adjacent to the gutter 30. During emptying of the receptacle 34, the debris 50 collected in the receptacle may cause the flap 90 to pivot upwardly from the closed orientation of FIGS. 4–7 to the open orientation of FIG. 8. Although the flap 90 could be omitted, it is believed that it may be preferred to provide the flap to accommodate the emptying of voluminous quantities of debris from the receptacle 34.

The downspout 32 is connected with the end wall 88 (FIG. 2) of the support member 80 by a hanger 94. The hanger 94 has a support section 96. A slot 98 in the support section 96 is engaged by a retaining hook 100 in the manner illustrated in FIG. 4. The downspout 32 is fixedly connected with the hanger 94.

An opening 104 (FIGS. 2 and 3) is formed in the bottom portion of a sidewall of the gutter 30. The opening 104 is aligned with the receptacle 34 and is offset to one side of the hanger 94. Therefore, water 42 and debris 50 from the gutter 30 flows through the opening 104 into the receptacle 34.

As was previously explained, the debris 50 is collected in the receptacle 34. However, the water can initially flow through the wall portion 46 and into engagement with a bottom wall 108 (FIG. 3) of the receptacle 34. The water then flows along the bottom wall 108 to a discharge spout 110 (FIGS. 2–4) from the receptacle 34. The discharge spout 110 is received in a collection section 114 (FIGS. 2–4) of the hanger 94. The water 42 flows through the discharge spout 110 of the receptacle 34 into the collection section 114 of the hanger 94 in the manner indicated schematically by the arrows in FIG. 4 until the wall portion 46 of the receptacle 34 becomes blocked by debris.

Although one specific manner of rotatably supporting the receptacle 34 beneath the gutter 30 has been illustrated in FIGS. 1 and 2, it is contemplated that the receptacle could be supported in a different manner if desired. For example, the receptacle could be supported by the downspout 32. If it is desired support the receptacle 34 with a downspout 32, the receptacle could be disposed either immediately beneath the gutter 30 as illustrated in FIGS. 1 and 2 or could be spaced from the gutter 30 along the length of the downspout 32.

Second Embodiment

In the embodiment of the invention illustrated in FIGS. 1–10, a single receptacle 34 is disposed beneath the gutter 30. The embodiment of the invention illustrated in FIGS. 11–14, a plurality of receptacles are disposed in series beneath the gutter. Since the embodiment of the invention illustrated in FIGS. 11–14 is generally similar to the embodiment of the invention illustrated in FIGS. 1–10, similar numerals will be utilized to designate similar components, the suffix letter "a" being associated with the numerals of FIGS. 11–14 to avoid confusion.

A gutter 30*a* receives rainwater from a roof or other portion of a building. Along with the rainwater, debris is conducted into the gutter 30*a*. A downspout (not shown) receives the water conducted from the gutter. The downspout conducts the water away from the building.

Figure 11:
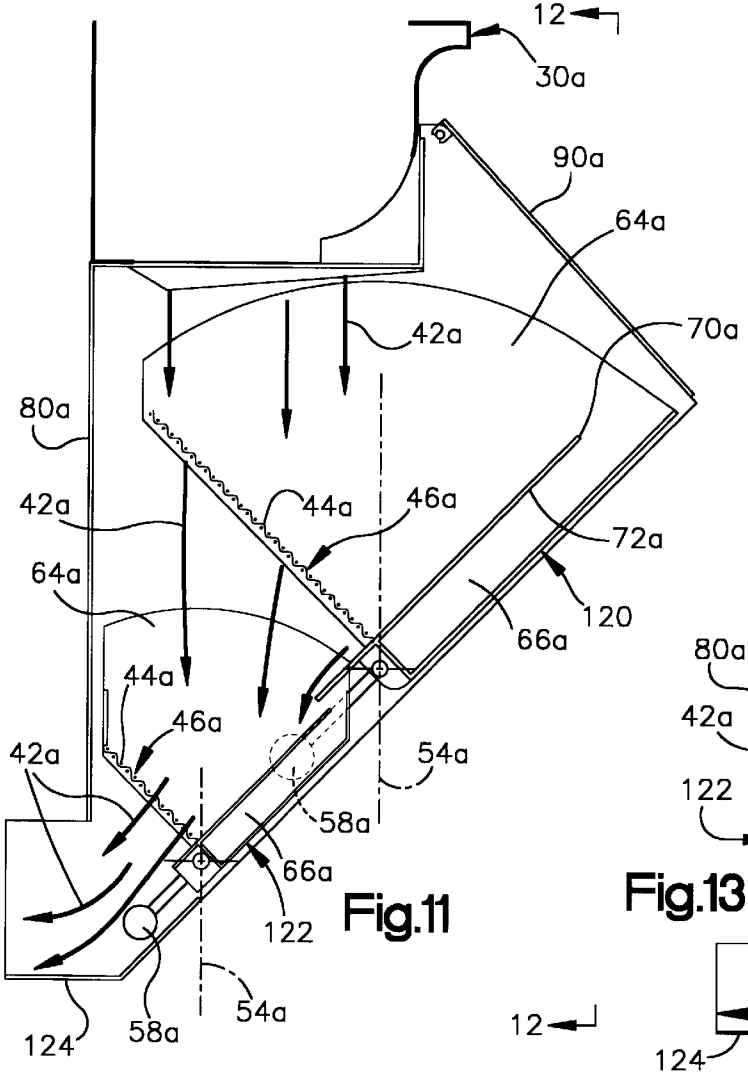
FIG. 11 is a fragmentary sectional view, generally similar to FIG. 4, of a second embodiment of the invention in which a plurality of receptacles are disposed in series along a flow path of water from the gutter to the downspout.

In accordance with a feature of this embodiment of the invention, a plurality of receptacles 120 and 122 (FIG. 11) are supported for rotational movement about horizontal axes by a support member 80*a*. Water 42*a*, indicated schematically by arrows in FIG. 11, is conducted through the receptacles 120 and 122 to a discharge spout 124 formed by the support member 80*a*. The discharge spout 124 is fixedly connected with the downspout (not shown).

The receptacle 120 has the same general construction and mode of operation as the receptacle 34 of FIGS. 1–10. However, the receptacle 120 does not have a bottom wall corresponding to the bottom wall 108 of the receptacle 34 (FIGS. 2 and 3). Thus, water 42*a* flows through an outlet 44*a* formed by a wall portion 46*a* of the first or upper receptacle 120 directly into the second or lower receptacle 122. The water then flows through an outlet 44*a* formed by a wall portion 46*a* of the second receptacle 122 to the discharge spout 124 which is connected with the downspout.

The illustrated embodiment of the upper receptacle 120 includes a main compartment 64*a* and a secondary compartment 66*a*. If desired, the secondary compartment 66*a* could be eliminated from the upper and lower receptacles 120 and 122. The upper receptacle 120 includes a counterweight 58*a* which urges the upper receptacle 120 toward the upright collecting orientation of FIG. 11. Similarly, the lower receptacle 122 includes a counterweight 58*a* which urges the lower receptacle 122 to the upright collecting orientation of FIG. 11.

Debris (not shown), such as leaves and other materials, will be conducted from the gutter 30*a* along with the water 42*a* into the upper receptacle 120. The debris will be separated from the flow of water 42*a* by the foraminous wall portion 46*a* of the upper receptacle 120. Therefore, only water 42*a* will flow from the upper receptacle 120 to the lower receptacle 122 when both of the receptacles are in the collecting orientations illustrated in FIG. 11. The water conducted through the wall portion 46*a* of the upper receptacle 120 flows through the wall portion 46*a* of the lower receptacle 122 to the discharge spout 124 which is connected with the downspout.

As debris accumulates in the upper receptacle 120, the flow of water through the wall portion 46*a* of the upper receptacle is blocked by the debris. As water continues to flow from the gutter 30*a* into the upper receptacle 120, the volume of water in the upper receptacle increases until the water flows over an upper edge or lip 70*a* on an inner wall 72*a* of the upper receptacle 120. The water then fills the secondary compartment 66*a* in the manner previously explained in conjunction with the embodiment of the invention illustrated in FIGS. 1–10.

As the water fills the secondary compartment 66*a*, the combined center of gravity of the upper receptacle 120 and the water and debris in the upper receptacle shifts from the left (as viewed in FIG. 11) side of a vertical plane 54*a* containing the axis of rotation of the upper receptacle 120 to the right side of the vertical plane. When this occurs, the upper receptacle 120 rotates from the collecting orientation of FIG. 11 to the emptying orientation of FIG. 13. When the receptacle 120 is in the emptying orientation of FIG. 13, water and debris is dumped from the receptacle 120. The counterweight 58*a* then causes the receptacle 120 to rotate back to the collecting orientation of FIG. 11.

Figure 13:
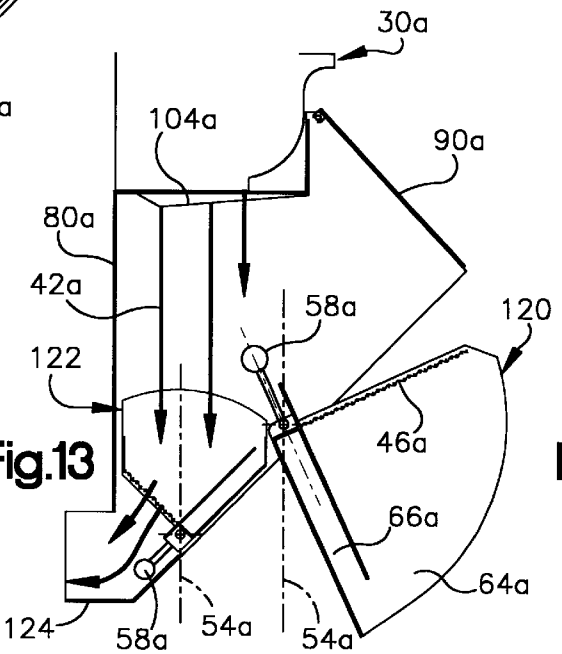
FIG. 13 is a simplified fragmentary illustration depicting a first one of the receptacles of FIG. 11 in an emptying orientation while water is conducted from the gutter through a second one of the receptacles.

During emptying of the receptacle 120, the receptacle 122 remains in the upright or collecting orientation shown in FIGS. 11 and 13. Therefore, water 42*a* flows through an opening 104*a* in the bottom of the gutter 30*a* into the receptacle 122 in the manner illustrated in FIG. 13. This water then flows through the discharge spout 124 to the downspout. Thus, during operation of the embodiment of the invention illustrated in FIGS. 11–14, the debris 50 does not flow through the apparatus in the manner illustrated schematically in FIG. 10 for the embodiment of the invention illustrated in FIGS. 1–10. The lower receptacle 122 collects any debris which is conducted through the opening 104*a* in the bottom of the gutter 30*a* during emptying of the receptacle 120.

After the receptacle 120 has been emptied numerous times, a substantial quantity of debris may collect in the lower receptacle 122. This debris will block the flow of water 42*a* through the wall portion 46*a* of the lower receptacle 122. When this occurs, water will accumulate in the main compartment 64*a* of the lower receptacle 122. Eventually, water will flow from the main compartment 64*a* into the secondary compartment 66*a*.

When the secondary compartment 66*a* of the lower receptacle 122 has become substantially full of water, the combined center of gravity of the receptacle 122 and the water 42*a* and debris in the receptacle will have shifted to the right (as viewed in FIG. 11) of a vertical plane 54*a* extending through the horizontal axis of rotation of the lower receptacle 122. When this occurs, the lower receptacle 122 will pivot from the upright collecting orientation of FIG. 11 to the emptying or discharge orientation of FIG. 14. When this occurs, the water and debris accumulated in the lower receptacle 122 will be dumped or discharged from the receptacle.

Figure 14:
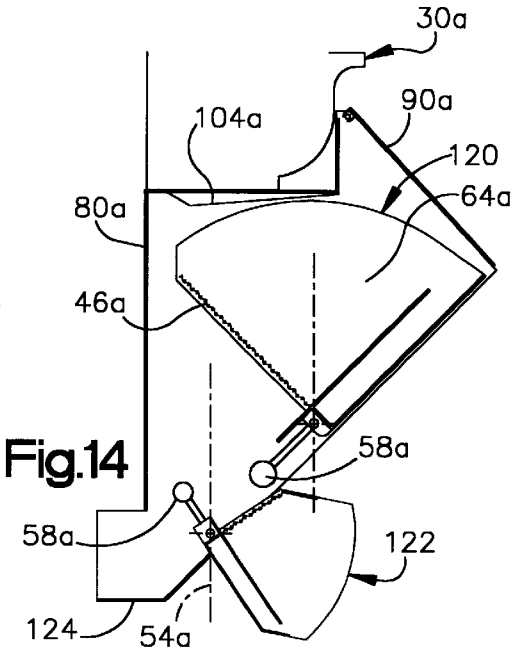
FIG. 14 is a fragmentary sectional view, generally similar to FIG. 13, illustrating the first receptacle in the collecting orientation and the second receptacle in the emptying orientation.

During emptying of the lower receptacle 122, the upper receptacle 120 will remain in the collecting orientation of FIG. 14. Therefore, water and debris conducted from the gutter 30*a* will enter the main compartment 64*a* of the upper receptacle 120. The water will pass through the wall portion 46*a* of the upper receptacle 120 and flow to the downspout through the discharge spout 124. Any debris which is included with the water conducted from the gutter 30*a* will be deposited against the foramens wall portion 46*a* of the upper receptacle 120.

Third Embodiment

A third embodiment of the invention is illustrated in FIGS. 15 through 19. In the embodiment of the invention illustrated in FIGS. 15 through 19, a plurality of receptacles are sequentially moved between a collecting orientation and an emptying orientation. Since the embodiment of the invention illustrated in FIGS. 15–19 is generally similar to the embodiments of the invention illustrated in FIGS. 1–14, similar numerals will be utilized to designate similar components, the suffix letter "b" being associated being associated with the numerals of FIG. 15 to avoid confusion.

Figure 16:
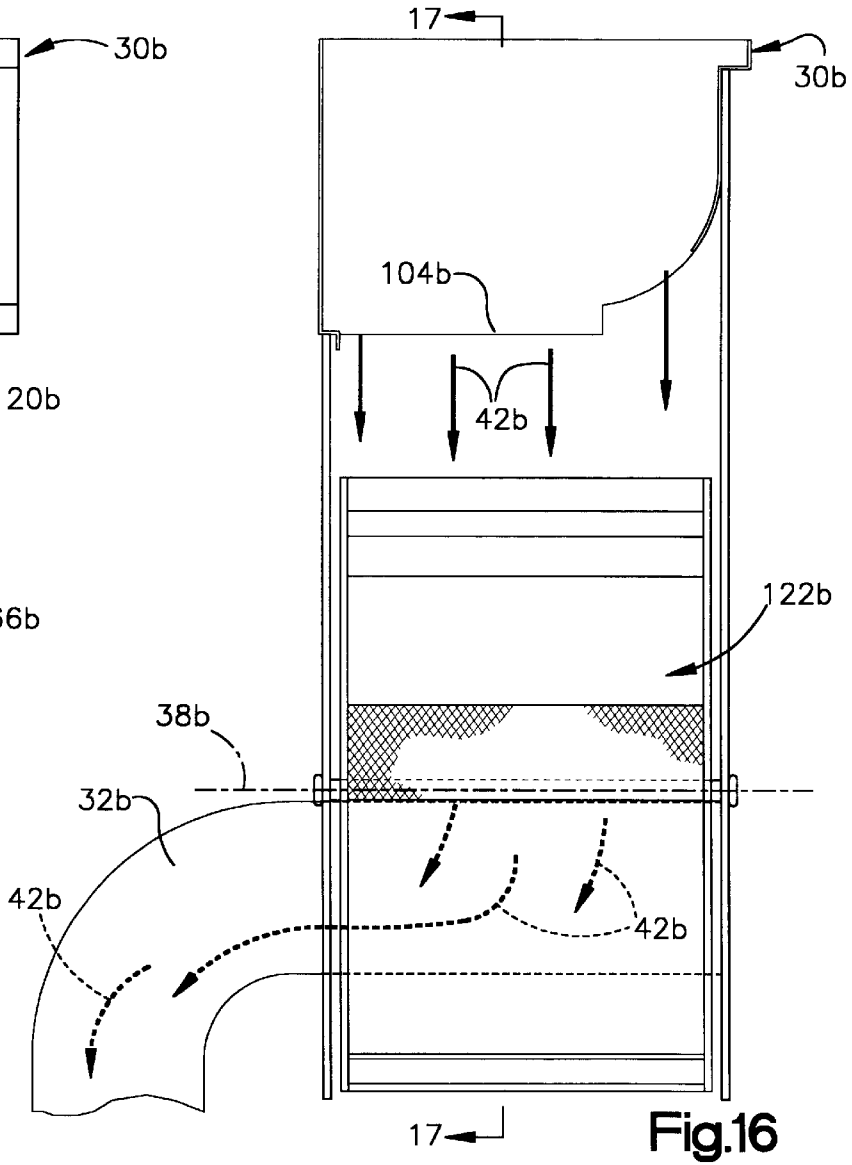
FIG. 16 is an elevational view, taken generally along the line 16—16 of FIG. 15.
Figure 15:
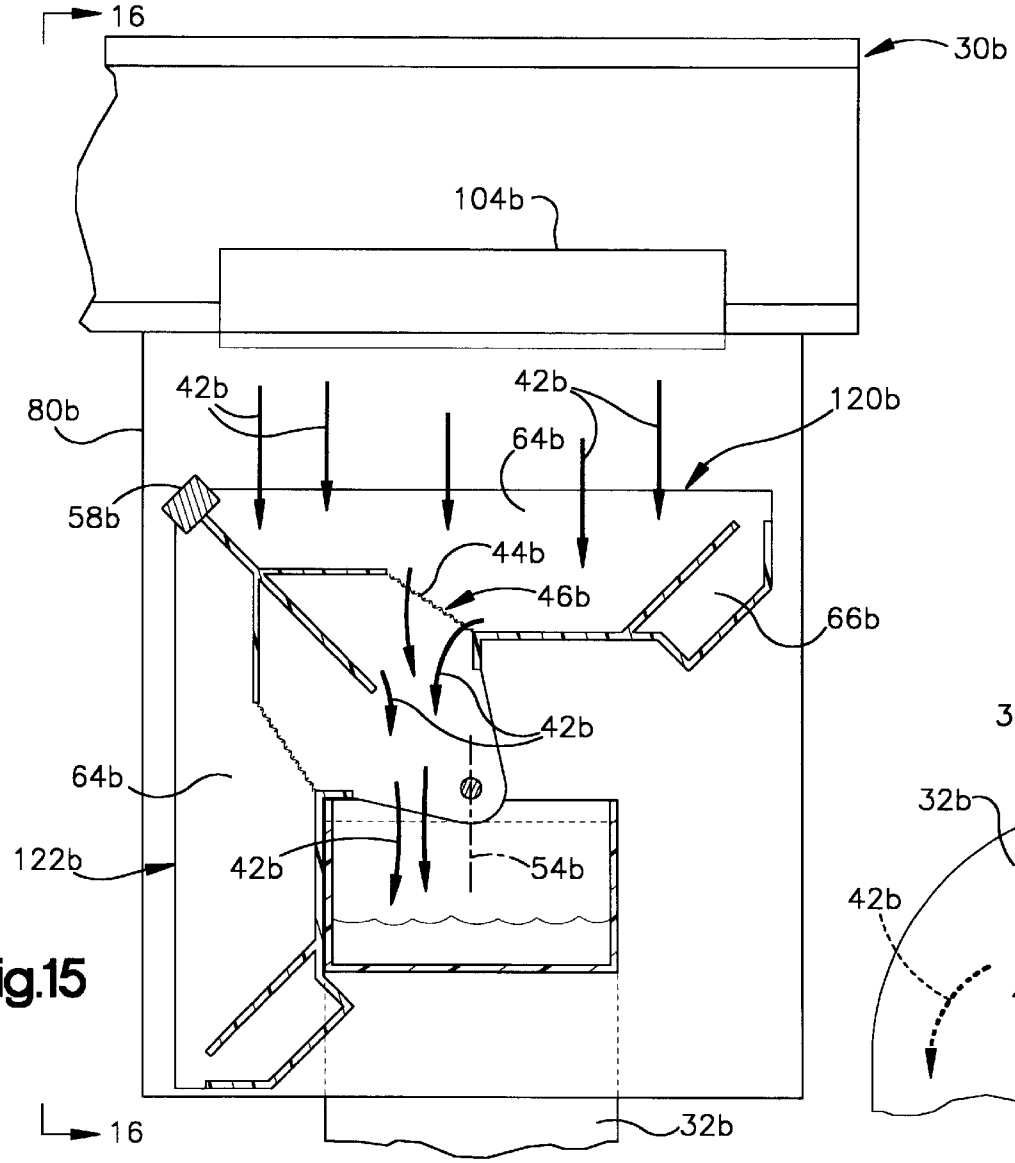
FIG. 15 is a simplified schematic sectional view of an embodiment of the apparatus having a plurality of receptacles which are sequentially filled with water and debris.

Rain water from a roof or other portion of a building is collected in a gutter 30*b* (FIGS. 15 and 16). The water, indicated schematically by arrows 42*b* is conducted by a downspout 32*b* to a location spaced from the building.

In accordance with a feature of this embodiment of the invention, a plurality of receptacles 120*b* and 122*b* (FIG. 15) are provided to receive water and debris conducted from the gutter 30*b*. The first receptacle 120*b* has a main compartment 64*b*. An outlet 44*b* from the main compartment 64*b* is formed by a foraminous wall portion 46*b*. The wall portion 46*b* is formed by a suitable mesh or screen. However, it is contemplated that the wall portion 46*b* could be formed by sheet material in which openings have been punched.

In addition to the main compartment 64*b*, the receptacle 120*b* includes a secondary compartment 66*b*. A counterweight 58*b* forms part of the receptacles 120*b* and 122*b*. When the receptacle 120*b* is in the collecting orientation illustrated in FIG. 15, the counterweight 58*b* urges the receptacle 120*b* to the collecting orientation. At the same time, the counterweight 58*b* is effective to urge the second receptacle 122*b* to the emptying orientation of FIG. 15.

Figure 17:
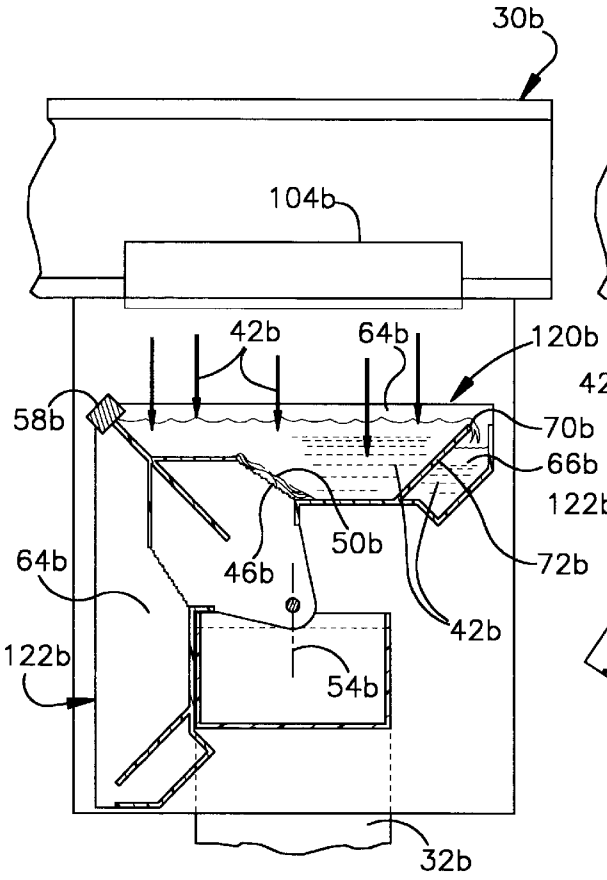
FIG. 17 is a schematic illustration, generally similar to FIG. 15, illustrating the manner in which an outlet from a first one of the receptacles is partially blocked by debris and the manner in which water accumulates in the first one of the receptacles.

Water and debris, such as leaves, sticks and other materials are conducted from the gutter 32*b* through the opening 104*b* to the first receptacle 120*b* in the manner illustrated schematically in FIGS. 15 and 17. The water flows through the wall portion 46*b* and into an open or upper end portion of the downspout 32*b* in the manner illustrated schematically in FIG. 15. Debris 50*b* conducted from the gutter 30*b* is collected against the wall portion 46*b* in the manner illustrated schematically in FIG. 17. As the debris 56*b* collects on the wall portion 46*b* of the first receptacle 120*b*, the debris blocks a flow of water 42*b* from the main compartment 64*b* of the first receptacle 120*b*. This results in an accumulation of water 42*b* in the main compartment 64*b* of the first receptacle 120*b*, in the manner illustrated schematically in FIG. 17.

As the water 42*b* accumulates in the main compartment 64*b* of the first receptacle 120*b*, it eventually flows over an upper end 70*b* of an inner wall 72*b* of the first receptacle 120*b* into a secondary compartment 66*b*. Prior to the flow of water over the upper end 70*b* of the inner wall 72*b*, a combined center of gravity of the first receptacle 120*b*, the second receptacle 122*b*, and the water 42*b* and debris 50*b* in the first receptacle 120*b* is disposed to the left (as viewed in FIGS. 15 and 17) of a vertical plane 54*b* containing an axis 38*b* (FIG. 16) about which the first and second receptacles 120*b* and 122*b* are rotatable.

However, as the water flows over the upper end 70*b* of the inner wall 72*b* into the secondary compartment 66*b* (FIG. 17), the center of gravity of the receptacles 120*b* and 122*b*, including the counterweight 58*b*, and of the water 42*b* and debris 50*b* in the first receptacle 120*b* moves toward the right. This results in the application of a clockwise (as viewed in FIG. 17) torque to the first receptacle 120*b* tending to rotate the first receptacle about the axis 38*b*. Thus, when the secondary compartment 66*b* is almost completely filled with water, the first receptacle 120*b* rotates about the axis 38*b* from the collecting orientation of FIG. 17 through the intermediate orientation of FIG. 18 to the emptying orientation of FIG. 19 under the influence of the weight of the water 42*b* and debris 50*b* in the first receptacle 120*b*.

Figure 19:
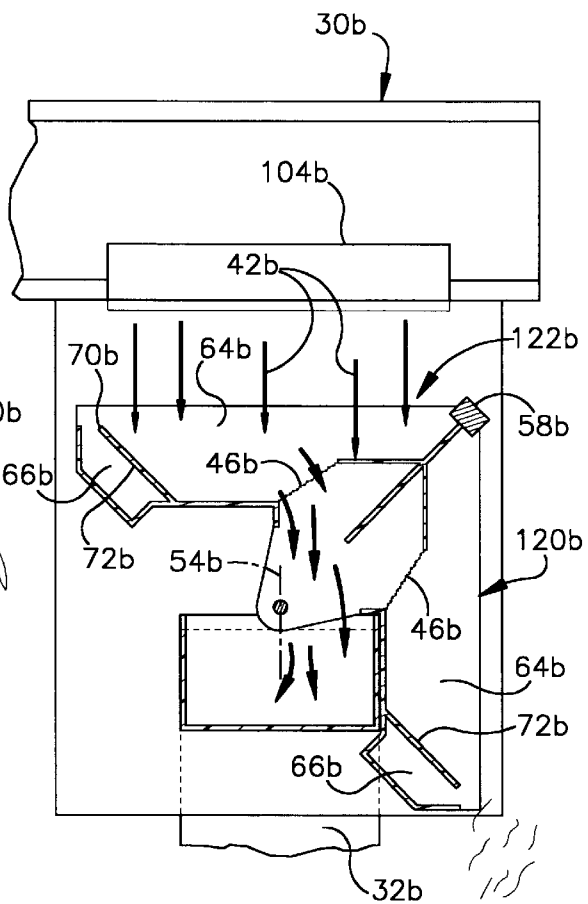
FIG. 19 is a schematic illustration, generally similar to FIGS. 17 and 18, illustrating the first one of the receptacles in an emptying orientation and a second one of the receptacles in a collecting orientation.

As the first receptacle 120*b* rotates in a clockwise direction (as viewed in FIG. 18), the counterweight 58*b* moves from a location disposed to the left (as viewed in FIG. 18) of the vertical plane 54*b* to a location disposed to the right of the vertical plane 54*b* (FIG. 19). When the counterweight 58*b* is in the position illustrated in FIG. 19, it is effective to hold the first receptacle 120*b* in the emptying orientation of FIG. 19. When the first receptacle 120*b* is in the emptying orientation of FIG. 19, the water 42*b* and debris 50*b* which had accumulated in the first receptacle 120*b* is dumped from the first receptacle.

During rotational movement of the first receptacle 120*b* from the collecting orientation of FIG. 17 to the emptying orientation of FIG. 19, the second receptacle 122*b* is rotated from the emptying orientation of FIG. 17 to the collecting orientation of FIG. 19. The second receptacle 122*b* has the same construction as the first receptacle 120*b*. The first and second receptacles 120*b* and 122*b* are fixedly interconnected so that they rotate together about the axis 38*b* (FIG. 16). Therefore, whenever the second receptacle 122*b* is in the emptying orientation of FIG. 17, the first receptacle 120*b* is in the collecting orientation. Similarly, whenever the second receptacle 122*b* is in the collecting orientation of FIG. 19, the first receptacle 120*b* is in the emptying orientation.

When the second receptacle 122*b* is in the collecting orientation of FIG. 19, water 42*b* flows from the opening 104*b* in the gutter 32*b* into the main compartment 64*b* of the second receptacle 122*b*. The water 42*b* flows through the foraminous wall portion 46*b* of the second receptacle 122*b*. Any debris in the water 42*b* is deposited on the wall portion 46*b* of the second receptacle 122*b* as the water flows through the wall portion.

As water 42*b* continues to flow into and through the second receptacle 122*b* to the downspout 32*b*, debris accumulates on the wall portion 46*b*. This results in a gradual blocking of the wall portion 46*b* of the second receptacle. As the wall portion 46*b* is gradually blocked, water accumulates in the main compartment 64*b* of the second receptacle 122*b*.

The water collected in the main compartment 64*b* of the second receptacle 122*b* eventually flows over an upper (as viewed in FIG. 19) end 70*b* of an inner wall 72*b* which separates the main compartment 64*b* from a secondary compartment 66*b*. This occurs in much the same manner as illustrated schematically for the receptacle 120*b* in FIG. 17.

As the secondary compartment 66*b* is filled with water, the combined center of gravity of the receptacles 120*b* and 122*b* and the water and debris in the receptacle 122*b* moves from the right (as viewed in FIG. 19) side of the vertical plane 54*b* containing the horizontal axis 38*b* of rotation of the receptacles 120*b* and 122*b*. As this occurs, the torque urging the receptacles 120*b* and 122*b* to rotate in a counterclockwise direction increases.

Figure 18:
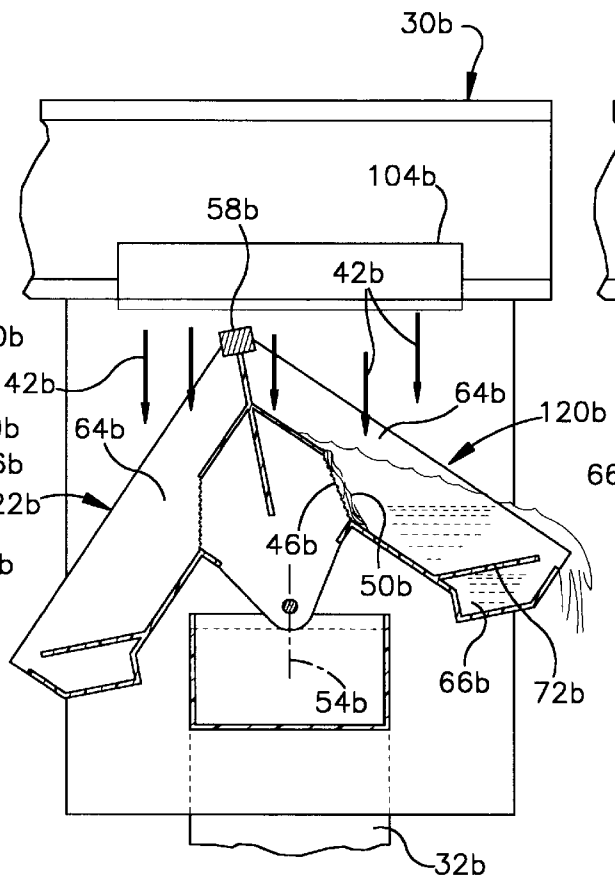
FIG. 18 is a schematic illustration, generally similar to FIG. 17, illustrating the manner in which the first one of the receptacles is rotated from the collecting orientation of FIG. 17 toward an emptying orientation under the influence of water and debris collected in the first one of the receptacles.

When the secondary compartment 66*b* of the second receptacle 122*b* is substantially filled with water, the second receptacle moves from the collecting orientation of FIG. 19 through the intermediate orientation of FIG. 18 to the emptying orientation of FIG. 17. When this occurs, the receptacle 120*b* is moved from the emptying orientation of FIG. 19 back to the collecting orientation of FIG. 17. Of course, movement of the second receptacle 122*b* to the emptying orientation (FIG. 17) results in the water and debris in the second receptacle being dumped from the receptacle.

Fourth Embodiment

Figure 20:
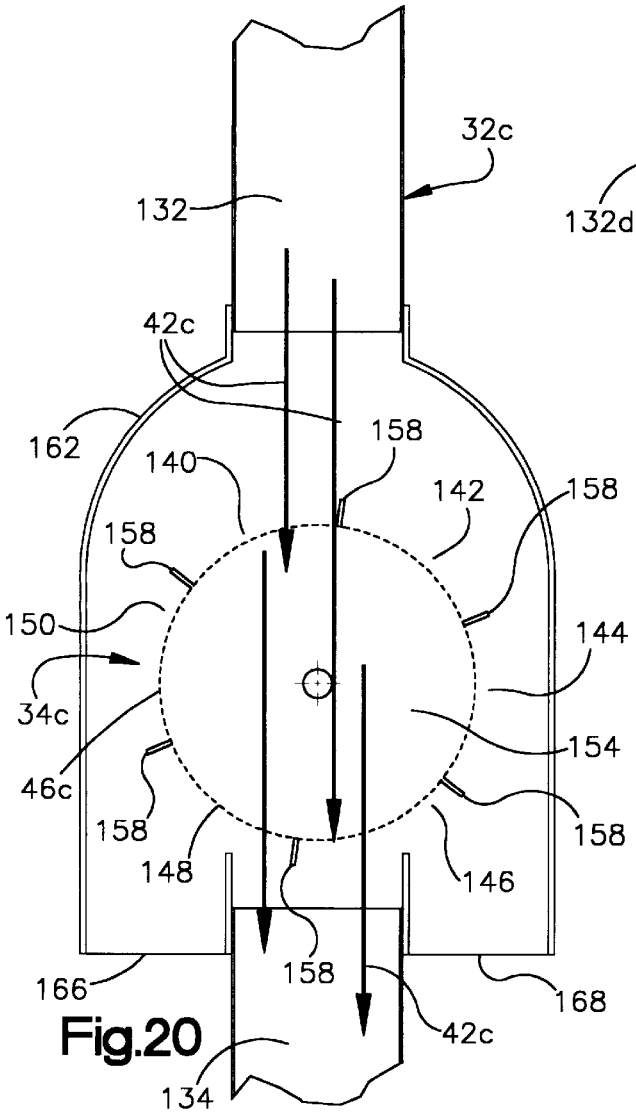
FIG. 20 is a simplified sectional view illustrating an embodiment of the invention in which a receptacle has a plurality of compartments disposed in a circular array.

In the embodiments of the invention illustrated in FIGS. 1–19, the receptacles have been rotatable through only a portion of a circle, that is, through a distance of less than 360 degrees. In the embodiment of the invention illustrated in FIGS. 20 and 21, the receptacles are movable through a complete circle. Since the embodiment of the invention illustrated in FIGS. 20 and 21 is generally similar to the embodiments of the invention illustrated in FIGS. 1–19, similar numerals will be utilized to designate similar components, the suffix letter "c" being associated with the numerals of FIGS. 20 and 21 to avoid confusion.

A downspout 32*c* has an upper section 132 and a lower section 134. The upper section 132 of the downspout 32*c* is connected in communication with a gutter, similar to the gutter 30 of FIG. 1. A receptacle 34*c* (FIGS. 20 and 21) is disposed between the upper and lower sections 132 and 134 of the downspout 32*c*.

Figure 21:
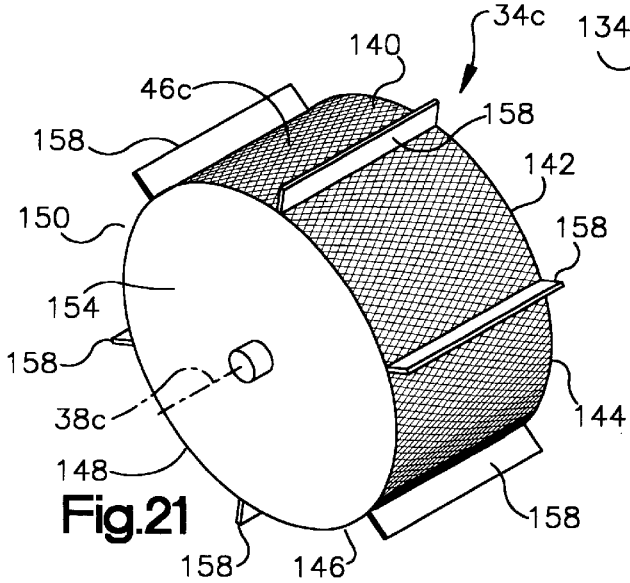
FIG. 21 is a pictorial illustration of a component of the apparatus of FIG. 20 and illustrating the relationship of sidewalls of the compartments to outlets through which water is connected from the compartments.

The receptacle 34*c* has a circular configuration and is rotatable about a horizontal axis 38*c* (FIG. 21). The receptacle 34*c* includes a circular array of compartments 140, 142, 144, 146, 148, and 150 (FIG. 20). The receptacles 140–150 are partially formed by a cylindrical foraminous wall portion 46*c*.

Each of the compartments 140–150 includes an arcuate segment of the foraminous wall portion 46*c*. The foraminous wall portion 46*c* is supported by a pair of parallel circular plates 154 (FIG. 21). Although only a single plate 154 has been illustrated in FIG. 21 as being connected with one end of the cylindrical wall portion 46*c*, it should be understood that a second plate is connected with the axially opposite end of the cylindrical wall portion 46*c*. A plurality of walls 158 project radially outward from the foraminous wall portion 46*c* to further define the compartments 140–150.

Water, indicated schematically by arrows 42*c* in FIG. 20 is conducted from the upper section 132 of the downspout 32*c* into a housing 162 which encloses the receptacle 34*c*. The water 42*c* passes through the foraminous wall portion 46*c* and flows into the lower section 134 of the downspout 32*c*. Any debris in the water 42*c* is accumulated in one of the compartments 140–150 on the foraminous wall portion 46*c*.

As the debris collects in one of the compartments 140–150, the center of gravity of the receptacle 34*c* is shifted relative to the axis 38*c*. This results in rotation of the receptacle 34*c* about the axis 38*c*. Rotation of the receptacle 34*c* moves each of the compartments 140–150 in turn from an upwardly facing orientation at an upper portion of the receptacle 34*c* to a downwardly facing orientation at a lower portion of the receptacle 34*c*. As the receptacle 34*c* rotates and the compartments 140–150 sequentially move to the downwardly facing emptying orientation, debris is dumped from the compartments and flows through passages 166 and 168 (FIG. 20) at the lower (as viewed in FIG. 20) end portion of the housing 162.

Fifth Embodiment

Figure 22:
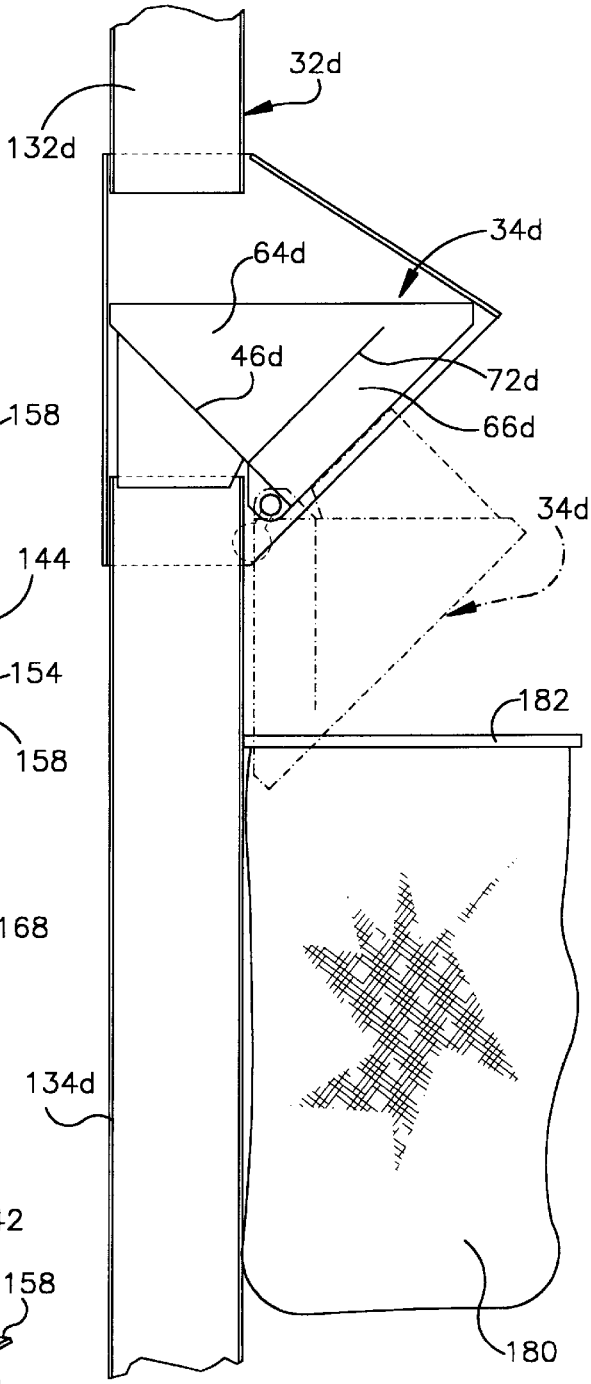
FIG. 22 is a simplified schematic illustration, generally similar to FIG. 4, illustrating the manner in which a bag may be mounted on the downspout to receive debris emptied from a receptacle.

In the embodiments of the invention illustrated in FIGS. 1–21, debris has been dumped from the receptacles to the environment adjacent to the downspout during movement of the receptacles from the collecting orientation to the emptying orientation. In the embodiment of the invention illustrated in FIG. 22, debris is dumped from the receptacle to a receiving container disposed adjacent to the receptacle. Since the embodiment of the invention illustrated in FIG. 22 is generally similar to the embodiments of the invention illustrated in FIGS. 1–21, similar numerals will be utilized to designate similar components, the suffix letter "d" being associated with the numerals of FIG. 22 to avoid confusion.

A downspout 32*d* includes an upper section 132*d* and a lower section 134*d*. The upper section 132*d* of the downspout is connected with a gutter, corresponding to the gutter 30 of FIG. 1. The upper section 132*d* of the downspout 32*d* conducts water and debris from the gutter to a receptacle 34*d* disposed between the upper and lower sections 132*d* and 134*d* of the downspout 32*d*.

The receptacle 34*d* has substantially the same construction and mode of operation as the receptacle 34 of FIGS. 1–10. The receptacle 34*d* includes a main compartment 64*d* into which water and debris is conducted from the upper section 132*d* of the downspout 32*d*. The water flows through a foraminous wall portion 46*d* of the receptacle 34*d*. The debris in the flow of water is deposited on the foraminous wall portion 46*d*.

As the debris gradually blocks the flow of water through the foraminous wall portion 46*d* of the receptacle 34*d*, water flows over an inner wall 72*d* of the receptacle 34*d* into a secondary compartment 66*d* of the receptacle. When the secondary compartment 66*d* of the receptacle 34*d* is substantially filled with water, the receptacle 34*d* pivots from the collecting orientation illustrated in solid lines in FIG. 22 to the emptying orientation illustrated in dashed lines in FIG. 22. The receptacle 34*d* rotates between the collecting and emptying orientations in the manner previously explained in conjunction with the embodiment of the invention illustrated in FIGS. 1–10.

In accordance with a feature of this embodiment of the invention, a container 180 is disposed adjacent to the lower section 134*d* of the downspout 32*d* to receive debris dumped from the receptacle 34*d* when the receptacle is in the emptying orientation illustrated in dashed lines in FIG. 22. Although it is contemplated that the container 180 could have many different constructions, the illustrated container is a bag. The bag forming the container 180 is connected with the lower section 134*d* of the downspout 32*d* by a circular support ring 182.

When the receptacle 34*d* rotates from the collecting orientation to the emptying orientation, the debris in the receptacle 34*d* is dumped into the container 180. The container 180 is periodically emptied.

CONCLUSION

The present invention relates to a new and improved method and apparatus for use in preventing blockage of a water flow path from a gutter 30 of a building through a downspout 32. The apparatus may include a receptacle 34 which is disposed beneath the gutter 30 and is connected in fluid communication with the downspout 32. A flow of water 42 and debris 50 from the gutter 30 is conducted into the receptacle 34.

A flow of water 42 is connected through an outlet 44 from the receptacle 34 while the debris 50 collects in the receptacle. As the debris 50 collects in the receptacle 34, it blocks the outlet 44 from the receptacle. As water 42 and debris 50 accumulate in the receptacle 34, their combined weight effects movement of the receptacle from the collecting orientation (FIGS. 4–6) to an emptying orientation (FIGS. 9 and 10) to dump the water and debris from the receptacle.

Figure 5:
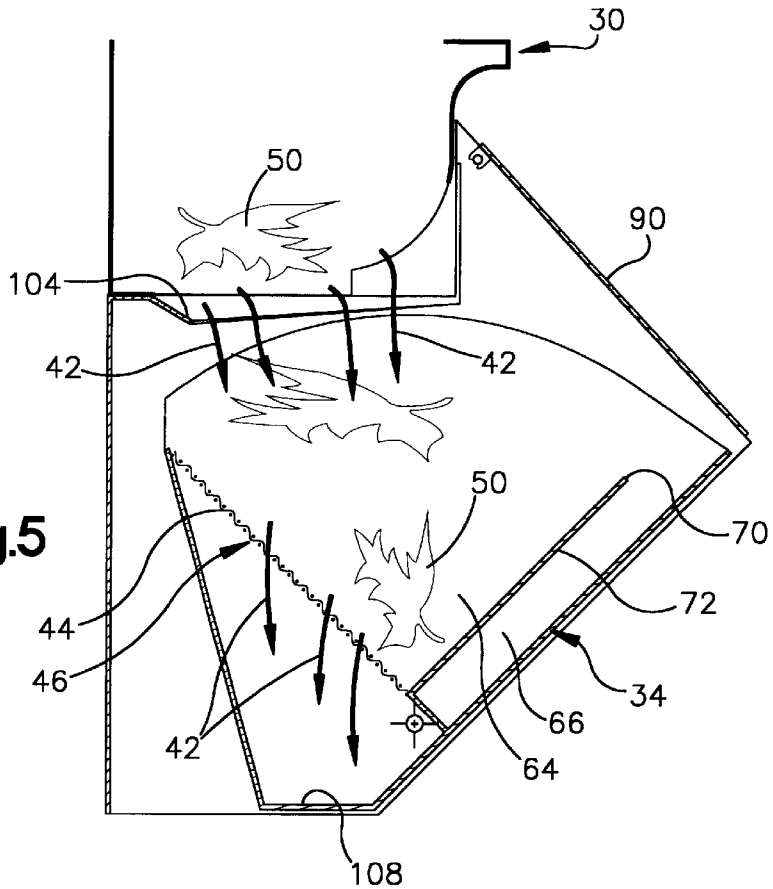
FIG. 5 is a fragmentary sectional view, taken generally along the line 5—5 of FIG. 3, illustrating the manner in which water flows through the receptacle and debris is collected in the receptacle.

In one specific embodiment of the receptacle 34, the outlet 44 from the receptacle is formed by a wall portion 46 of the receptacle through which the water 42 passes prior to collection of debris in the receptacle (FIGS. 4 and 5). As the debris 50 accumulates in the receptacle 34, the center of gravity of the combined mass of the receptacle and the water 42 and debris in the receptacle may move from an location disposed on one side of an axis 38 about which the receptacle is rotatable to an opposite side of the axis. As this occurs, the weight of the water 42 and debris 50 collected in the receptacle 34 causes the receptacle to rotate from the collecting orientation to the emptying orientation.

The receptacle 34 may have a plurality of compartments. In one embodiment of the invention, a main compartment 64 of the receptacle 34 is filled with water and debris. A secondary compartment 66 of the receptacle 34 receives water 42 from the main compartment 64. As the secondary compartment 66 is filled with water, the center of gravity of the receptacle 34 and the water 42 and debris 50 moves relative to an axis 38 about which the receptacle is rotatable to cause rotation of the receptacle to dump the water and debris from the receptacle.

In another embodiment of the invention, a plurality of receptacles 120 and 122 (FIGS. 11–19) sequentially receive water and debris. When a first one of the receptacles 120*b* (FIG. 17) becomes at least partially filled with water and debris, the receptacle 120*b* is moved from a collecting orientation to an emptying orientation. As the first receptacle 120*b* moves from the collecting orientation (FIG. 17) to the emptying orientation (FIG. 18), a second receptacle 122*b* moves to the collecting orientation and receives water and debris. The receptacles may be disposed in any one of several spatial relationships relative to each other including a circular array (FIGS. 20 and 21). If desired, a plurality of receptacles 120 and 122 may be arranged in series along a path flow of water 42*a* from a gutter 30*a* (FIG. 11).

From the above description of the invention, those skilled in the art will perceive improvements, changes and modifications. Such improvements, changes and modifications within the skill of the art are intended to be covered by the appended claims.

Having described the invention, the following is claimed:

1. An apparat us for use in preventing blockage of a water flow path from a gutter of a building through a downspout, said apparatus comprising a receptacle adapted to be at least partially disposed beneath the gutter and adapted to be connected in fluid communication with the downspout, and a support connected with the receptacle, said receptacle being movable relative to said support from a collecting orientation to an emptying orientation under the influence of a weight of water and debris conducted from the gutter to said receptacle when said receptacle is in the collecting orientation, said receptacle having a wall portion through which water passes prior to collection of debris in said receptacle and which becomes at least partially blocked with debris conducted from the gutter to enable said receptacle to accumulate a quantity of water and debris sufficient to effect movement of said receptacle from the collecting orientation to the emptying orientation, said receptacle includes a plurality of compartments, a first one of said compartments receives a flow of water and debris from the gutter and has an outlet which is at least partially formed by said wall portion and through which water flows until the outlet is blocked by debris, a second one of said compartments receives water from said first one of said compartments when the flow of water through said outlet is at least partially blocked by debris collected in said first compartment.

2. An apparatus as set forth in claim 1 wherein said receptacle is rotatable about an axis of rotation during movement of said receptacle from the collecting orientation to the emptying orientation, said receptacle being effective to hold water and debris with a center of gravity of a combined mass of said receptacle and the water and debris on a first side of a vertical plane containing the axis of rotation said receptacle is in the collecting orientation, said receptacle being effective to hold water and debris with a center of gravity of the combined mass of the receptacle and the water and debris on a second side of the vertical plane containing the axis of rotation upon initiation of movement of said receptacle from the collecting orientation to the emptying orientation.

3. An apparatus as set forth in claim 1 wherein an open upper end portion of said receptacle is disposed beneath an opening through which water and debris from the gutter are conducted when said receptacle is disposed in the collecting orientation, said open upper end portion of said receptacle being at least partially offset to one side of the opening through which water and debris is conducted from the gutter when said receptacle is in the emptying orientation.

4. An apparatus as set forth in claim 1 further including a biasing element which urges said receptacle to move from the emptying orientation to the collecting orientation upon discharge of water and debris from said receptacle when said receptacle is in the emptying orientation.

5. An apparatus as set forth in claim 4 wherein said biasing element is a counterweight.

6. An apparatus as set forth in claim 1 wherein water and debris are discharged from said first and second compartments upon movement of said receptacle from the collecting orientation to the emptying orientation.

7. An apparatus as set forth in claim 1 wherein said receptacle is rotatable about an axis during movement of said receptacle from the collecting orientation to the emptying orientation, said first compartment having a center on a first side of a vertical plane containing said axis and said second compartment having a center on a second side of the vertical plane.

8. An apparatus as set forth in claim 1 wherein said wall portion of said first one of said compartments includes a screen which forms said outlet and is engaged by debris collected in said first compartment during a flow of water through said first compartment.

9. An apparatus as set forth in claim 1 wherein said first compartment has an end portion through which water and debris flow into said first compartment when said receptacle is in the collecting orientation, said end portion of said first compartment being disposed in an orientation which enables water and debris to flow from said receptacle through said end portion of said first compartment when said receptacle is in the emptying orientation.

10. An apparatus for use in preventing blockage of a water flow path from a gutter of a building through a downspout, said apparatus comprising a receptacle adapted to be at least partially disposed beneath the gutter and connected in fluid communication with the downspout, and a support connected with the receptacle, said receptacle being movable relative to said support from a collecting orientation to an emptying orientation under the influence of the weight of water and debris conducted from the gutter to said receptacle when said receptacle is in the collecting orientation, said receptacle is rotatable about an axis of rotation during movement of said receptacle from the collecting orientation to the emptying orientation, said receptacle being effective to hold water and debris with a center of gravity of a combined mass of said receptacle and the water and debris on a first side of a vertical plane containing the axis of rotation when said receptacle is in the collecting orientation, said receptacle being effective to hold water and debris with a center of gravity of the combined mass of said receptacle and water and debris on a second side of the vertical plane through the axis of rotation upon initiation of movement of said receptacle from the collecting orientation to the emptying orientation, said receptacle includes a plurality of compartments, a first one of said compartments receives a flow of water and debris from said gutter and has an outlet through which water flows until the outlet is blocked by debris, a second one of said compartments receives water from said first one of said compartments when the flow of water through said outlet is at least partially blocked by debris collected in said first compartment.

11. An apparatus as set forth in claim 10 wherein an open upper end portion of said receptacle is disposed beneath an opening through which water and debris from the gutter are conducted when said receptacle is disposed in the collecting orientation, said open upper end portion of said receptacle being at least partially offset to one side of the opening through which water and debris are conducted when said receptacle is in the emptying orientation.

12. An apparatus as set forth in claim 10 further including a biasing element which urges said receptacle to move from the emptying orientation to the collecting orientation upon discharge of water and debris from said receptacle when said receptacle is in the emptying orientation.

13. An apparatus as set forth in claim 12 wherein said biasing element is a counterweight.

14. A method as set forth in claim 10 wherein water and debris are discharged from said first and second compartments upon movement of said receptacle from the collecting orientation to the emptying orientation.

15. An apparatus as set forth in claim 10 wherein said receptacle is rotatable about an axis of rotation during movement of said receptacle from the collecting orientation to the emptying orientation, said first compartment having a center on a first side of a vertical plane containing said axis of rotation and said second compartment having a center on a second side of the vertical plane.

16. An apparatus for use in preventing blockage of a water flow path from a gutter of a building through a downspout, said apparatus comprising a receptacle adapted to be at least partially disposed beneath the gutter and connected in fluid communication with the downspout, a support connected with said receptacle to support said receptacle for rotational movement relative to said downspout, said receptacle being rotatable between a collecting orientation in which water and debris conducted from the gutter are accumulated in said receptacle and an emptying orientation in which water and debris accumulated in said receptacle are dumped from said receptacle, said receptacle having a center of gravity which is disposed on a first side of a vertical plane containing an axis about which said receptacle is supported for rotational movement, said receptacle being effective to hold a mass of water and debris having a center of gravity which is disposed on a second side of the vertical plane containing the axis about which said receptacle is rotatable, said receptacle being rotatable from the collecting orientation to the emptying orientation under the influence of the weight of the mass of water and debris when a center of gravity of a combined mass of the receptacle and the water and debris moves from the first side of the vertical plane to a second side of the vertical plane, said receptacle includes a counterweight having a center of gravity on the first side of the vertical plane.

17. An apparatus as set forth in claim 10 wherein said receptacle has an outlet through which water passes prior to accumulation of debris in said receptacle and which becomes at least partially blocked with debris conducted from the gutter to enable a mass of water and debris to collect in said receptacle sufficient to result in a center of gravity of the combined mass of the receptacle and the water and debris to be on the second side of the vertical plane.

18. An apparatus as set forth in claim 16 wherein said receptacle has an opening through which water and debris flow into said receptacle when said receptacle is in the collecting orientation and through which water and debris flow from said receptacle when said receptacle is in the emptying orientation.

19. An apparatus comprising a building gutter having a downspout, a receptacle disposed beneath said gutter and connected in fluid communication with said gutter and downspout, and a support connected with said receptacle and said downspout, said receptacle being movable relative to said support from a collecting orientation to an emptying orientation under the influence of a weight of water and debris conducted from said gutter to said receptacle when said receptacle is in the collecting orientation, said receptacle having an opening at one end portion of said receptacle through which water and debris flow into said receptacle when said receptacle is in the collecting orientation and through which water and debris flow from said receptacle when said receptacle is in the emptying orientation, said receptacle having an outlet through which water passes prior to collection of debris in said receptacle and which becomes at least partially blocked with debris conducted from the gutter to enable said receptacle to accumulate a quantity of water and debris sufficient to effect movement of said receptacle from the collecting orientation to the emptying orientation.

20. An apparatus as set forth in claim 19 wherein said receptacle is rotatable about an axis of rotation during movement of said receptacle from the collecting orientation to the emptying orientation, said receptacle being effective to hold water and debris when said receptacle is in the collecting orientation, said receptacle being effective to discharge water and debris through the opening in the one end portion of said receptacle upon movement of said receptacle from the collecting orientation to the emptying orientation.

21. An apparatus as set forth in claim 19 wherein said opening at said one end portion of said receptacle faces upward and is disposed beneath an opening through which water and debris from the gutter are conducted when said receptacle is disposed in the collecting orientation, said opening at said one end portion of said receptacle faces downward when said receptacle is in the emptying orientation.

22. An apparatus as set forth in claim 21 further including a biasing element which urges said receptacle to move from the emptying orientation to the collecting orientation upon discharge of water and debris from said receptacle when said receptacle is in the emptying orientation.

23. An apparatus as set forth in claim 22 wherein said biasing element is a counterweight.

24. An apparatus as set forth in claim 19 wherein said receptacle includes a plurality of compartments, a first one of said compartments receives a flow of water and debris from said gutter, a second one of said compartments receives water from said first one of said compartments when a level of water in said first one of said compartments rises above a predetermined level.

25. An apparatus as set forth in claim 24 wherein water is discharged from said second compartment upon movement of said receptacle from the collecting orientation to the emptying orientation.

26. An apparatus comprising a building gutter having a downspout, a receptacle disposed beneath said gutter and connected in fluid communication with said gutter and downspout, and a support connected with said receptacle and said downspout, said receptacle including a compartment which is movable relative to said support from a first orientation in which an opening to said compartment faces upward and said compartment is effective to hold water and debris to a second orientation in which said opening to said compartment faces downward and said compartment is ineffective to hold water and debris under the influence of the weight of water and debris conducted from said gutter to said compartment when said compartment is in the first orientation, said compartment having an outlet through which water passes prior to collection of debris in said compartment when said compartment is in the first orientation and which becomes at least partially blocked with debris conducted from said gutter to enable said compartment to accumulate a quantity of water and debris sufficient to effect movement of said compartment from the first orientation to the second orientation.

27. A method of preventing blockage of a water flow path from a gutter of a building through a downspout, said method comprising the steps of conducting a flow of water and debris from the gutter into a receptacle through a first opening in the receptacle, conducting a flow of water from the receptacle through a second opening in the receptacle while debris and water collects in the receptacle, and dumping the water and debris from the receptacle through the first opening in the receptacle when the second opening in the receptacle is at least partially blocked by the debris, said step of dumping the water and debris includes moving the receptacle under the influence of a weight of water and debris collected in the receptacle.

28. A method as set froth in claim 27 wherein a center of gravity of a combined mass of the receptacle and the water and debris collected in the receptacle moves as the volume of water and debris in the receptacle increases, said step of dumping water and debris from the receptacle is performed in response to movement of the center of gravity of the combined mass of the receptacle and the water and debris collected in the receptacle as the mass of water and debris in the receptacle increases.

29. A method as set forth in claim 27 wherein said step of dumping the water and debris from the receptacle is performed in response to a center of gravity of the combined mass of the receptacle and water and,debris moving from a location disposed on a first side of a vertical plane to a location on a second side of the vertical plane.

30. A method as set forth in claim 27 wherein said step of dumping the water and debris from the receptacle includes rotating the receptacle from a collecting orientation to an emptying orientation.

31. A method of preventing blockage of a water flow path from a gutter of a building through a downspout, said method comprising the steps of conducting a flow of water and debris from the gutter into a first compartment in a receptacle while the receptacle is in a collecting orientation, conducting a flow of water from the first compartment of the receptacle to a second compartment of the receptacle while the receptacle is in the collecting orientation, moving the receptacle from the collecting orientation to an emptying orientation in response to accumulation of water in the second compartment of the receptacle, and conducting a flow of water and debris from the first and second compartments of the receptacle when the receptacle is in the emptying orientation.

32. A method as set forth in claim 31 further including the step of conducting a flow of water from the receptacle while the receptacle is in the collecting orientation and prior to conducting a flow of water from the first compartment of the receptacle to the second compartment of the receptacle.

33. A method as set forth in claim 31 further including the step of moving the receptacle from the emptying orientation to the collecting orientation under the influence of the weight of the receptacle after having conducted a flow of water and debris from the first and second compartments while the receptacle is in the emptying orientation.

34. A method as set forth in claim 31 wherein said step of conducting a flow of water and debris into the first compartment in the receptacle includes conducting the flow of water and debris into the first compartment of the receptacle through a first opening in the receptacle, said step of conducting a flow of water and debris from the first and second compartments of the receptacle when the receptacle is in the emptying orientation includes conducting a flow of water and debris through the first opening in the receptacle.

* * * * *

UNITED STATES PATENT AND TRADEMARK OFFICE

CERTIFICATE OF CORRECTION

PATENT NO. : 6,219,972 B1
DATED : April 24, 2001
INVENTOR(S) : Matthew S. Zusy

It is certified that error appears in the above-identified patent and that said Letters Patent is hereby corrected as shown below:

Column 15,
Line 66, change "10" to -- 16 --.

Column 17,
Line 37, after "and" (second occurrence) delete ",".

Signed and Sealed this

Twenty-third Day of April, 2002

*Attest:*

*Attesting Officer*

JAMES E. ROGAN
*Director of the United States Patent and Trademark Office*